US006394444B1

(12) United States Patent
Ito et al.

(10) Patent No.: US 6,394,444 B1
(45) Date of Patent: May 28, 2002

(54) BANK-NOTE PROCESSING DEVICE

(75) Inventors: Yukio Ito, Saitama; Yasuyuki Kodama, Sakado; Noboru Yamagishi, Tsurugashima; Tadashi Hatamachi, Sakado, all of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/555,774

(22) PCT Filed: Oct. 4, 1999

(86) PCT No.: PCT/JP99/05443

§ 371 (c)(1),
(2), (4) Date: Jun. 1, 2000

(87) PCT Pub. No.: WO00/21043

PCT Pub. Date: Apr. 13, 2000

(30) Foreign Application Priority Data

Oct. 6, 1998 (JP) ..... 10-284517

(51) Int. Cl.[7] ..... B65H 29/44

(52) U.S. Cl. ..... 271/180; 271/178; 271/3.2; 271/220

(58) Field of Search ..... 271/3.2, 177, 178, 271/180, 181, 220

(56) References Cited

U.S. PATENT DOCUMENTS 4,858,744 A * 8/1989 Dolejs et al. ..... 271/181
5,421,443 A * 6/1995 Hatamachi et al. ..... 271/180
5,564,691 A * 10/1996 Hatamachi et al. ..... 271/178
5,597,061 A 1/1997 Nishiumi et al.
5,876,033 A * 3/1999 Lonati ..... 271/180
5,899,452 A * 5/1999 Walsh ..... 271/180

FOREIGN PATENT DOCUMENTS

JP 3-288762 12/1991
JP 7-125896 5/1995
JP WO 99/62034 A 12/1999

OTHER PUBLICATIONS

International Search Report mailed Feb. 1, 2000 which issued in connection with the above–identified Japanese patent applications.

* cited by examiner

*Primary Examiner*—Joseph E. Valenza
*Assistant Examiner*—Mark A. Deuble
(74) *Attorney, Agent, or Firm*—Welsh & Katz, Ltd.

(57) ABSTRACT

A bank-note processing device wherein disposed between a pair of rotary drums (22, 23) is a stacker lever (53) that presses that portion of the bank-note (31) inserted in bank-note guide slits (22*b*, 23*b*) which is positioned on the side of a bank-note reverse-flowing-preventive lever (32) toward a stacker (20) in operative association with the movement of a stacker chute (51), whereby even if a large number of wrinkled bank-notes are received in the stacker, jamming of bank-notes is minimized.

2 Claims, 19 Drawing Sheets

BANK-NOTE PROCESSING DEVICE

TECHNICAL FIELD

The present invention relates to a bank-note processing device used for e.g. a vending machine, a money changing machine, a pachinko ball dispenser and a metal token dispenser.

BACKGROUND ART

In a main unit of dispensers handling bank-notes (including coupons), a bank-note processing device for judging the genuineness of an inserted bank-note and for storing only bank-notes regarded as genuine is normally equipped.

The bank-note processing device is generally comprised of bank-note transporting means, which guides a bank-note inserted from a bank-note slot to the main body of the unit, bank-note identification means which judges the genuineness of the transported bank-note, bank-note shifting means which sequentially parallel shifts the inserted bank-notes judged as genuine, and a stacker which sequentially stacks and stores the bank-notes parallel shifted via the bank-note transporting means.

FIG. 13 is a conceptual cross-sectional side view of a major portion of a bank-note processing device 1, which the applicant of the present invention proposed in the Japanese Patent Application No. 10-141350.

This bank-note processing device is comprised of a rectangular main body 2, and a front mask 4, where a bank-note slot 3 is formed, is removably attached at the lower part of the front face 2*a* of the main body 2.

The front mask 4, where the bank-note slot 3 is formed, is attached such that the tip, that is, the bank-note slot 3, is exposed to the outside from a front mask attachment hole formed on a door at the front face of such equipment as a dispenser, which is not illustrated.

A bank-note detection sensor 5 for judging whether a bank-note is inserted from the bank-note slot 3 is disposed directly behind the bank-note slot 3 formed in the front mask 4, and a roughly L-shaped bank-note transporting route 6, which is connected to the bank-note slot 3 and then rises upwards, is disposed in the front mask 4 directly behind the bank-note direction sensor 5 and in the main body of the unit 2. And shutter means 7 for opening/closing the bank-note transporting route 6 is disposed upstream of the bank-note-transporting route 6.

The shutter means 7 is comprised of a motor, which is not illustrated, and a shutter 7*a* which moves in the horizontal direction shown by the arrow A via the shutter driving means, such as a rack engaging with a pinion gear of the motor.

The bank-note transporting route 6 connected to the bank-note slot 3 is comprised of a horizontal portion 6*a*, which is roughly parallel with the bank-note insertion direction, and a vertical portion 6*b*, which rises up roughly in the vertical direction from the end of the horizontal portion 6*a*.

The bank-note transporting means 6 for transporting the inserted bank-note upstream along with bank-note transporting route 6 is disposed on the L-shaped bank-note transporting route 6.

This bank-note transporting means 8 is comprised of a looped bank-note transporting belt 9, which is stretched along the horizontal portion 6*a* and the vertical portion 6*b* of the bank-note transporting route 6, and belt driving means 10, which is comprised of a motor 9' and other parts for driving and rotating of the bank-note transporting belt 9.

The belt driving means 10 is also comprised of pulleys 11 and 12 for looping and stretching the bank-note transporting belt 9, and slave pulleys 13 and 14, which are pressed against the cylindrical surface of the pulleys 11 and 12, and an idle pulley for adjusting the tension of the belt is pressed against a part of the bank-note transporting belt 9.

The bank-note identification means 16 comprised of various sensors, including magnetic sensors for judging the genuineness of an inserted bank-note and photo sensors arranged facing each other, is disposed in the vertical portion 6*b*, which is positioned upstream of the bank-note transporting route 6.

In accordance with this bank-note processing device 1, when a bank-note is inserted into the bank-note slot 3, the bank-note detection sensor 5, which is disposed in the front mask 4, detects the presence of the inserted bank-note, and the inserted bank-note is transported horizontally to the right as shown in the drawing, along the horizontal portion 6*a* of the bank-note transporting route 6, by the bank-note transporting belt 9 of the bank-note transporting means 8, which rotates counterclockwise, which is the normal rotation, based on the detection signal. When the inserted bank-note passes through the vertical portion 6*a* of the bank-note-transporting route 6, the genuineness of the inserted bank-note is judged by the bank-note identification means 16 disposed therein.

If the bank-note identification means 16 judges the inserted bank-note as counterfeit, the bank-note transporting belt 9 rotates in reverse (clockwise rotation), so as to return the inserted bank-note back through the bank-note slot 3.

If the bank-note identification means 16 judges the inserted bank-note as genuine, the bank-note transporting belt 9 continues normal rotation based on the detection signal, and the inserted bank-note is transported to the upper part of the main body 2 along the vertical portion 6*b* of the bank-note transporting route 6.

In the main body 2, bank-note shifting means 21 temporarily houses the bank-note transported via the bank-note transporting means 8, and then parallel shifts the bank-note judged as genuine to the stacker 20.

Even though the details on the structure of the bank-note shifting means 21 are the same in the Japanese Patent Application No. 5-276592, the structure will be briefly explained here.

FIG. 14 is a conceptual plan view of the above mentioned bank-note shifting means 21 viewed from the AA direction in FIG. 13.

This bank-note shifting means 21 is disposed with a predetermined space (a space slightly wider than the width of the bank-notes to be handled) and comprises a pair of rotary drums 22 and 23 which rotate in opposite directions at a same phase, a pair of engaging protrusions 24*a* and 24*b* which engage with the engaging concave portions 22*a* and 23*a* formed at the center area of the pair of rotary drums 23 and 24, and a stacker chute 24 which rotates at a predetermined angle in the vertical direction of the drawing with a shaft 25 as a center when the rotary drums 22 and 23 make one rotation.

On both sides of the shaft 25, which rotatably supports the stacker chute 24, a pair of pulleys 26 where a pair of bank-note transporting belts 9 constituting the bank-note transporting means 8 (FIG. 13) are looped, are secured. On both sides of the shaft 25, another pair of pulleys 27, constituting the bank-note transporting means 8, are also secured.

On this pair of drive pulleys 27, another pair of bank-note transporting belts 28 are looped respectively, and this pair of bank-note transporting belts 28 loop a pair of pulleys 30 respectively, which are rotatably supported on both sides of the shaft 29 disposed at the tip of the stacker chute 24. Therefore, if the shaft 25 is rotated by the bank-note transporting belt 9, the bank-note transporting belt 28 interlocking with the bank-note transporting belt 9 is driven and rotated at the same time.

According to such a bank-note shifting means 21, a bank-note transporting belts 9 and 28 constituting the bank-note transporting means 8 are driven and rotated counterclockwise, as shown in FIG. 15, which is the conceptual BB cross-sectional view in FIG. 14, and when the inserted bank-note 31 is transported in the arrow C direction via the bank-note transporting route 6 (FIG. 13), the bank-note 31 is inserted into the pair of bank-note guide slits 22*b* and 23*b* formed along the longitudinal direction of the cylindrical faces of the rotary drums 22 and 23 of the bank-note shifting means 21, and then the longitudinal side of the inserted bank-note 31 is inserted to the above pair of bank-note guide slits 22*b* and 23*b* formed on the rotary drums 22 and 23, as shown in FIG. 16, and is temporarily stored there.

As FIG. 15 shows, the width of the leading ends 22*b*' and 23*b*' of the pair of bank-note guide slits 22*b* and 23*b* is formed slightly wider than the other parts so that both ends of the inserted bank-note 31 in the width direction can be easily guided into the bank-note guide slits 22*b* and 23*b*.

In FIG. 13 to FIG. 16, the numeral 32 is a bank-note reverse-flowing-preventive lever, which is, disposed roughly at the center of the pair of rotary drums 22 and 23.

As FIG. 16 shows, this bank-note reverse-flowing-preventive lever 32 prevents the bottom end 36*a* of the bank-note 36 stored in the stacker 20 via the bank-note shifting means 21 from returning to the bank-note guide slits 22*b* and 23*b* side of the rotary drums 22 and 23, blocking the slits, and this bank-note reverse-flowing-preventive lever 32 is comprised of a roughly L-shaped lever 34 supported with the shaft 33 as a center such that the lever can freely rotate at a predetermined rotation angle, and a return spring 35 which constantly exerts force on this lever 34 in the counterclockwise direction, as shown in FIG. 15, and the bank-note reverse-flowing-preventive lever 34 is secured at a position where the tip of the roughly L-shaped lever 34 does not block the leading ends 22*b*' and 23*b*' of the bank-note guide slits 22*b* and 23*b* at the initial position shown in FIG. 15.

In FIG. 15 and FIG. 16, the numeral 37 is a presser bar which presses the bank-note 36 stored in the stacker 20, and this presser bar 37 constantly exerts force on the external surface of the rotary drums 22 and 23 by the exerting force of the coil spring 38.

In FIG. 15 and FIG. 16, the numeral 40 is a return spring whereby one end engages the rear face of the stacker chute 24 and the other end engages a part of the main unit 2 (FIG. 13), and this return spring 40 constantly exerts force on the stacker chute 24 in the counterclockwise direction with the shaft 25 at the center, whereby the pair of engaging protrusions 24*a* and 24*b* shown in FIG. 14 are engaged with the corresponding engaging concave portions 22*a* and 23*a* of each rotary drum 22 and 23.

Now the operation of the above mentioned bank-note shifting means 21 will be explained.

As FIG. 16 shows, after the inserted bank-note 31, including its rear end 31*a*, is stored in the bank-note guide slits 22*b* and 23*b* of the pair of rotary drums 22 and 23, the pair of rotary drums 22 and 23 start rotation in directions which are opposite to each other at a same phase, shown by arrow marks, from the initial positions shown in FIG. 16 via such driving means as a motor, which is not illustrated, based on a detection signal of the detection means, not illustrated, which detects the inserted bank-note 31, then the bank-note 31 inserted in the bank-note guide slits 22*b* and 23*b* of the rotary drums 22 and 23 is parallel shifted to the stacker 20 side interlocking with the rotation movement of each bank-note guide slit 22*b* and 23*b*.

As soon as the rotary drums 22 and 23 rotate, the engaging concave portions 22*a* and 23*a* in FIG. 14 rotate as well, so the stacker chute 24 rotates clockwise with the shaft 25 as the center as shown in FIG. 17 via the pair of engaging protrusions 24*a* and 24*b* which engage with those engaging concave portions 22*a* and 23*a*, so that the center area of the rear face of the bank-note 31 inserted in the bank-note guide slits 22*a* and 23*b* is pressed, and the inserted bank-note 31 is pushed from the bank-note guide slits 22*b* and 23*b* to the slacker 20 side in parallel so as to store the inserted bank-note 31 overlapping the inserted bank-notes 36 stored in the stacker 20.

At this time, that is, when the inserted bank-note 31 is pushed out of the bank-note guide slits 22*b* and 23*b* by the stacker chute 24, the bottom end 3 la of the inserted bank-note 31 contacts the tip of the roughly L-shaped lever 34 constituting the bank-note reverse-flowing-preventive lever 32, and passes through while rotating the lever 34 clockwise with the shaft 33 as the center. Then the lever 34, which contact with the bottom end 31*a* of the inserted bank-note is released, returns to the initial position (FIG. 15) by the exerting force of the return spring 35.

The rotary drums 22 and 23, on the other hand, maintain rotation even after the inserted bank-note 31 is parallel shifted into the stacker 20, and when the engagement between the engaging concave portions 22*a* and 23*a* of the rotary drums and the pair of the engaging protrusions 24*a* and 24*b* of the stacker chute 24 (FIG. 14) are released by the rotation of the rotary drums 22 and 23, the stacker chute 24 rotates counterclockwise with the shaft 25 as the center by the exerting force of the return spring 40, and returns to the initial position, as shown in FIG. 18. When the stacker chute 24 returns to the initial position in FIG. 18, the rotary drums 22 and 23 stop rotation and return to the standby position where the next bank-note will be inserted into the bank-note guide slits 22*b* and 23*b*.

According to the above mentioned bank-note processing device 1, if the inserted bank-note 31 stored in the stacker 20 by the bank-note shifting means 21 returns toward the bank-note shifting means 21 for any reason, the bottom end 31 of the inserted bank-note 31 contacts the roughly L-shaped lever 34 constituting the reverse-flowing-preventive lever 32 and the return is prevented, as shown in FIG. 18, therefore, the leading ends 22*b*' and 23*b*' of the bank-note guide slits 22*b* and 23*b* formed on the rotary drums 22 and 23 are constantly open. As a consequence, the next inserted bank-note can easily be inserted into the bank-note guide slits 22*b* and 23*b*, by which collision of the bank-note stored first and the bank-note to be stored next is avoided and bank-note jamming can be prevented.

According to the above mentioned conventional bank-note processing device 1, the reverse-flowing-preventive lever 32 prevents the inserted bank-note 31 stored in the stacker 20 from returning to the bank-note shifting means 21 side, therefore the leading ends 22*b*' and 23*b*' of the bank-note guide slits 22*b* and 23*b* formed on the rotary drums 22 and 23 are constantly open, so that the next inserted bank-note can easily be inserted into the bank-note guide slits 22*b* and 23*b* and jamming of the bank-note at the bank-note shifting means 21 can be prevented as much as possible, but when a large number of bank-notes 36 are stored in the stacker 20, particularly when a large number of wrinkled bank-notes are stored in the stacker 20, as shown in the cross-sectional view of the major portion of the bank-note processing device 1 in FIG. 19, air enters among the stacked bank-notes 36, which causes a large swelling at the center area in the width direction of the stored bank-notes.

If a large number of wrinkled bank-notes are stored in the stacker 20 and the center area in the width direction swells as just stated, the rotary drums 22 and 23 rotate as FIG. 20 shows, whereby the stacker chute 24 presses the rear face of the center area of the inserted bank-note 31, and as a result, the bottom end 31*a* of the inserted bank-note 31 to be parallel shifted to the stacker 20 side does not move, being pressed by the rear ends 36*a* of the swelled bank-notes 36, and the bottom end 31*a* of the inserted bank-note 31 stops at a position before the roughly L-shaped lever 34 constituting the bank-note reverse-flowing-preventive lever 32.

If the bottom end 31*a* of the inserted bank-note 31 stops at a position before the roughly L-shaped lever 34 constituting the bank-note reverse-flowing-preventive lever 32, as shown in FIG. 20, the bottom end 31*a* of the inserted bank-note 31 blocks the leading ends 22*b*' and 23*b*' of the bank-note guide slits 22*b* and 23*b* of the rotary drums 22 and 23, as shown in FIG. 21, and as a result, the bank-note transported next collides with the bottom end 31*a* of the above bank-note 31, blocking the leading ends 22*b*' and 23*b*' of the bank-note guide slits 22*b* and 23*b*, causing bank-note jamming.

Also according to the bank-note transporting means 8 of the above mentioned conventional bank-note processing device 1, the pair of pulleys 26 and 27, where the pair of bank-note transporting belts 9 are looped, are secured on both sides of the shaft 25 which rotatably supports the stacker chute 24, another pair of bank-note transporting belts 28 loop the pair of pulleys 27, and the other ends of the pair of bank-note transporting belts 28 loop the pair of pulleys 30 which are supported by both ends of the shaft 29 disposed at the tip of the stacker chute 24, as shown in FIG. 14, and this complicated structure with many parts becomes the cause of an increase cost in manufacturing.

Also according to the shutter means 7 of the conventional bank-note processing device 1, the pinion formed on the driving shaft of the motor, not illustrated here, is engaged with the rack disposed at the rear end of the shutter 7*a*, and this pinion is driven and rotated by the motor, as shown in FIG. 13, so that the shutter 7*a* is moved in the horizontal direction shown by the arrow mark A in FIG. 13, whereby the bank-note transported route 6 is opened/closed.

In this way, the conventional bank-note processing device 1 uses the pinion and the rack as a driving device for opening/closing the shutter 7*a*, that is, the rotation direction of the pinion is the opposite when the shutter 7*a* is moved to the right direction shown in FIG. 13 to close the bank-note transporting route 6, and when the shutter 7*a* is moved to the left direction shown in FIG. 13 to open the bank-note transporting route 6.

This means that the rotating direction of the motor for driving the pinion must be changed as well, therefore the open/close control of the shutter 7*a* is difficult, and if the sensor, not illustrated here, fails and the closing of the bank-note transporting route 6 by the shutter 7*a* cannot be detected, then the pinion keeps rotating in the shutter closing direction, and as a result, the shutter 7*a* and the chute constituting the bank-note transporting route 6 contact, locking the shutter 7*a*, which will damage the shutter means 7*b* itself.

With the foregoing in view, the present invention has been made.

It is a first object of the present invention to provide a bank-note-processing unit where bank-note jamming will occur as infrequent as possible, even if a large number of wrinkled bank-notes are stored in the stacker.

It is a second object to provide a bank-note-processing unit having a bank-note transporting means which structure is simple, without using many parts.

It is a third object to provide a bank-note-processing unit where the open/close control of the shutter is easy, and the open/close operation of the shutter is stable.

DISCLOSURE OF THE INVENTION

To achieve the first object, a first aspect of the present invention is a bank-note processing device comprising: bank-note shifting means for temporarily inserting a bank-note transported from a bank-note slot and then parallel shifting the bank-note so as to store the bank-note in a stacker, having a pair of rotary drums which rotate in directions opposite from each other at a same phase, bank-note guide slits which are formed in the longitudinal direction of each cylindrical surface of the pair of rotary drums for temporarily inserting the above transported bank-note, and a stacker chute which interlocks with the rotation of the above pair of rotary drums for pushing roughly the center area of the bank-note inserted into the above bank-note guide slits toward the above stacker side; and a bank-note reverse-flowing-preventive lever which is disposed between the above pair of rotary drums and near the leading ends of the bank-note guide slits for engaging with the bottom end of the bank-note parallel shifted from the bank-note guide slits to the stacker side, so as to prevent the return of the bank-note parallel shifted to the stacker side, characterized in that a stacker lever for pushing a portion positioned at the bank-note reverse-flowing-preventive lever side of the bank-note inserted in the bank-note guide slits toward the stacker side is disposed between the above pair of rotary drums.

To achieve the second object, a second aspect of the present invention is a bank-note processing device comprising: bank-note shifting means for temporarily inserting a bank-note inserted from a bank-note slot and then parallel shifting the bank-note so as to store the bank-note in a stacker, having a pair of rotary drums which rotate in directions opposite from each other at a same phase, bank-note guide slits which are formed in the longitudinal direction of each cylindrical surface of the pair of rotary drums for temporarily inserting the above inserted bank-note, and a stacker chute which interlocks with the rotation of the above pair of rotary drums for pushing roughly the center area of the bank-note inserted in the above bank-note guide slits toward the above stacker side; and bank-note transporting means for transporting the bank-note inserted from the bank-note slot along the bank-note guide slits of the pair of rotary drums, characterized in that the above bank-note transporting means further comprises a shaft disposed adjacent to the free end side of the above stacker chute, a pair of pulleys supported by both ends of the shaft, and a pair of bank-note transporting belts which loop the pair of pulleys respectively, and the pair of bank-note transporting belts are stretched along the above bank-note guide slits from the leading ends of the bank-note guide slits so as to transport the inserted bank-note along the bank-note guide slits from the leading ends of the bank-note guide slits when the bank-note transporting belts are driven and rotated.

To achieve the third object, a third aspect of the present invention is a bank-note processing device comprising shutter means for opening/closing a bank-note transporting route, characterized in that the above shutter means further comprises a shutter slidably disposed toward the above bank-note transporting route, and a crank mechanism which converts the rotational driving force of a motor in one direction to a reciprocating motion of the shutter for the bank-note transporting route.

BEST MODE FOR CARRYING OUT THE INVENTION

An embodiment of a bark-note-processing unit in accordance with the present invention will now be described in detail.

Figure 1:
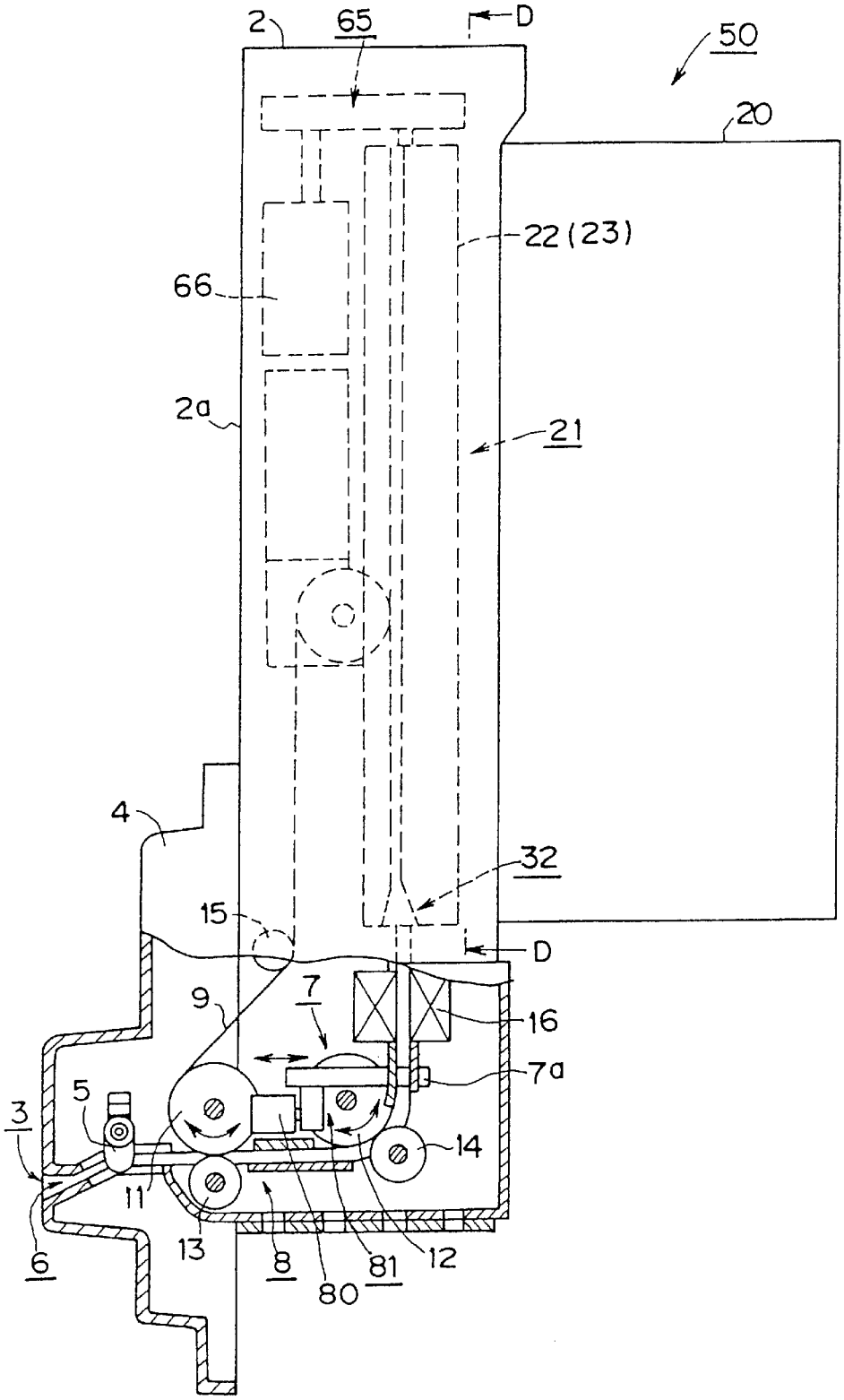
FIG. 1 is a conceptual cross-sectional side view of a major portion of a bank-note-processing unit in accordance with the present invention.
Figure 13:
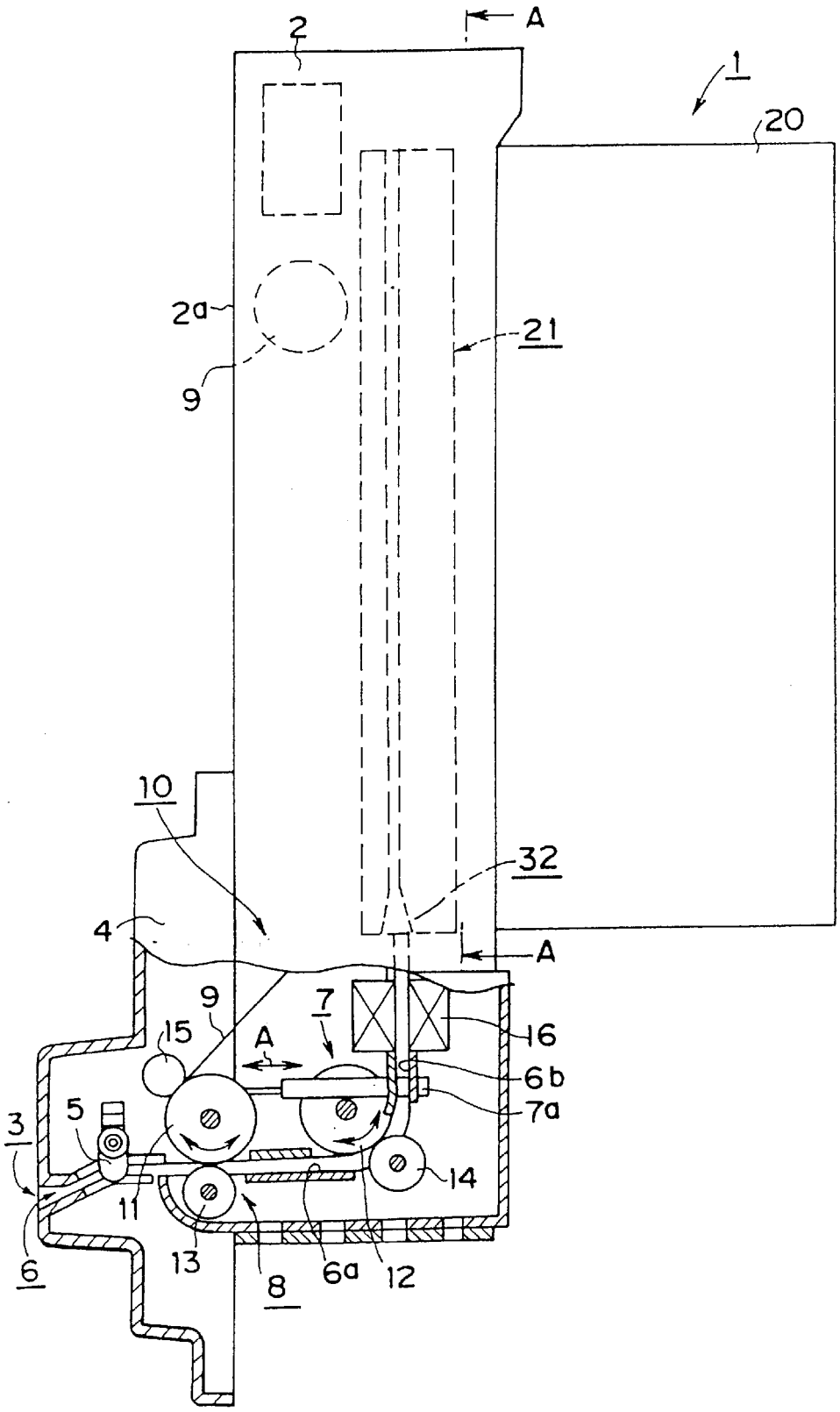
FIG. 13 is a conceptual cross-sectional side view of a conventional bank-note-processing unit.

FIG. 1 is a conceptual cross-sectional side view of a major portion of a bank-note processing device 50 in accordance with the present invention, where identical parts as FIG. 13 are denoted by the same numerals.

Compared with the prior art in FIG. 13, the structure of this bank-note processing device 50 is completely different in the following four aspects.

(1) The structure of bank-note shifting means 21, which temporarily stores a bank-note transported via the bank-note transporting means 8 then parallel shifts the bank-note judged as genuine into the stacker 20 (the portion related to the first aspect of the present invention).

(2) The structure of the bank-note transporting means 8, which stores an inserted bank-note in the bank-note in the bank-note guiding slots 22*b* and 23*b* of the pair of rotary drums 22 and 23 along the L-shaped bank-note transporting route 6, then transfers the inserted bank-note upstream of the bank-note guide slits 22*b* and 23*b* (the portion related to the second aspect of the present invention).

(3) The structure of a driving device for driving the pair of drums 22 and 23, which are the major components of the bank-note shifting means 21.

(4) The structure of the shutter means for opening/closing the bank-note transporting route 6 (the portion related to the third aspect of the present invention).

The structure portions which differ from the above mentioned prior art will now be described in detail, beginning with the portion related to the first aspect of the present invention, that is, the structure of the bank-note shifting means 21 stated in (1).

Figure 2:
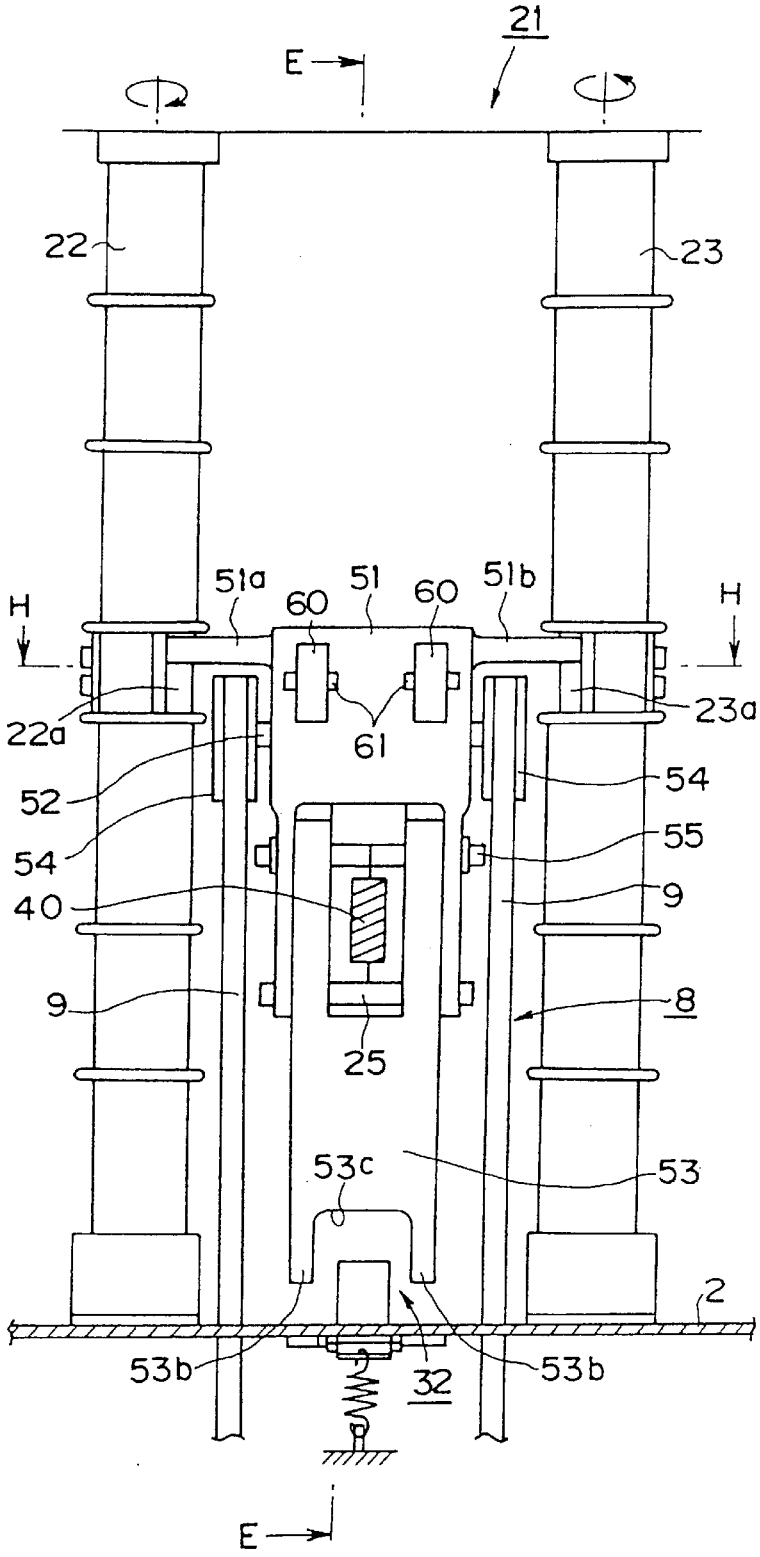
FIG. 2 is a conceptual front view of the bank-note shifting means in accordance with the present invention.
Figure 14:
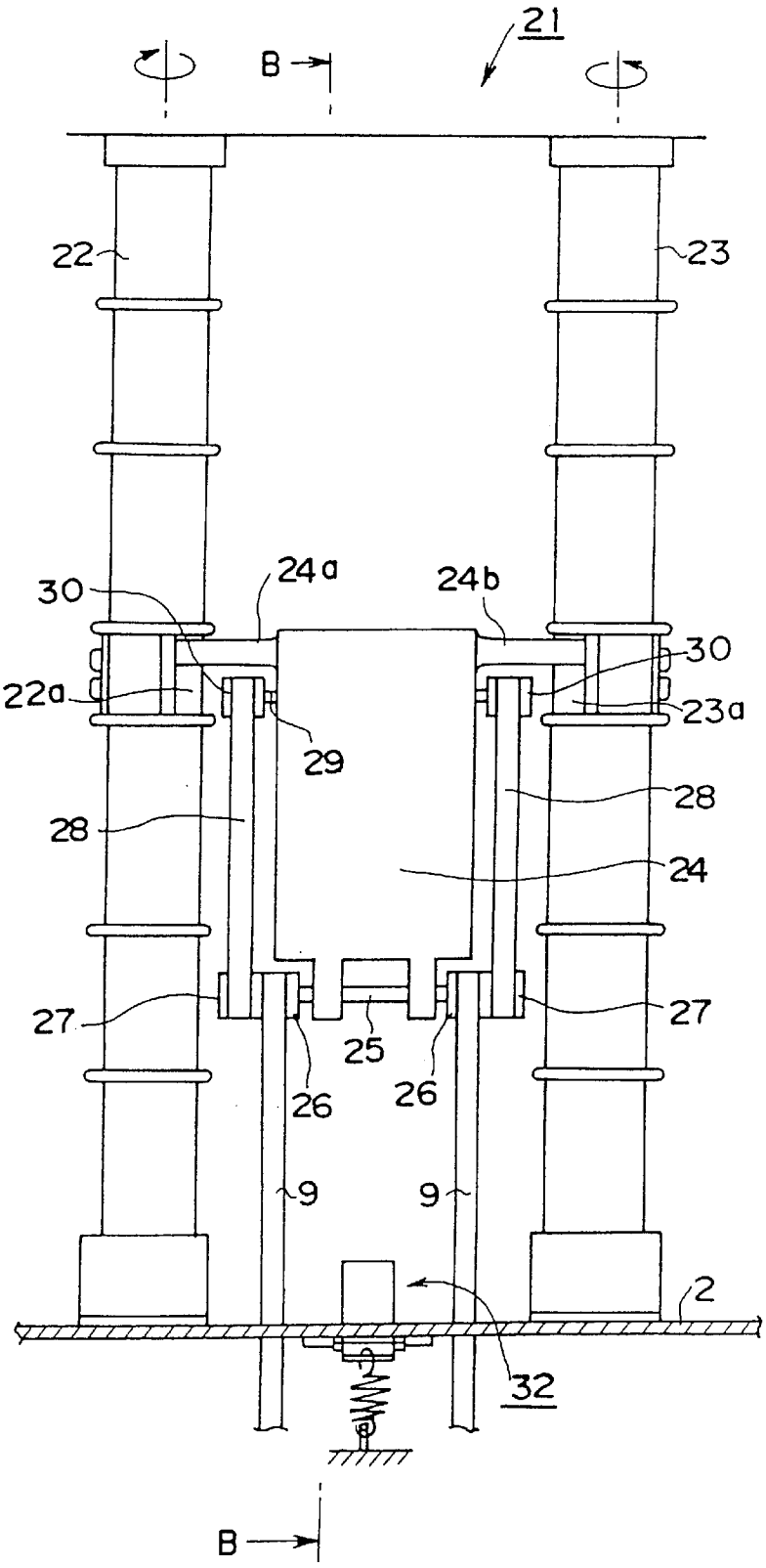
FIG. 14 is a conceptual front view depicting the conventional bank-note shifting means.
Figure 15:
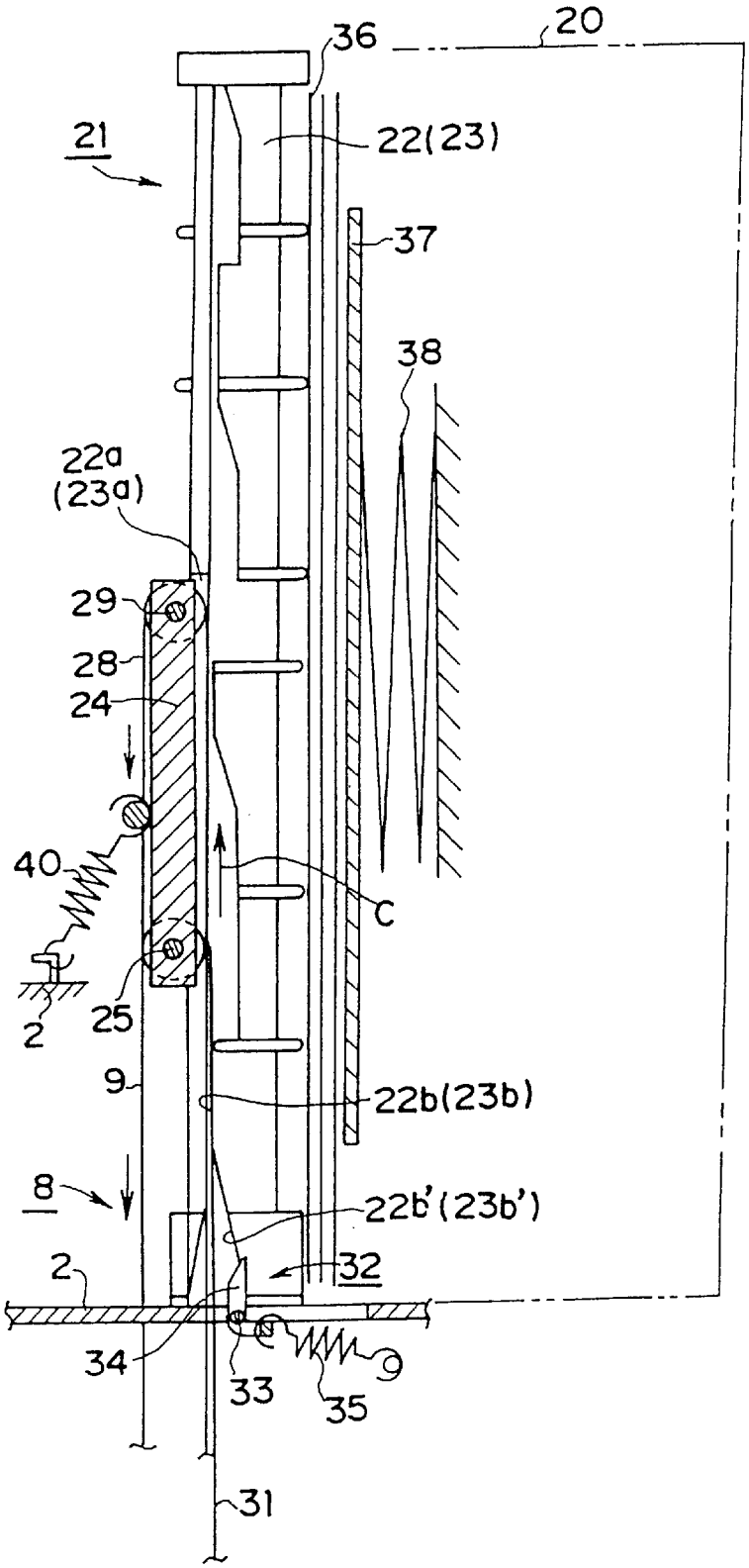
FIG. 15 is a conceptual side view depicting a function of the conventional bank-note shifting means.
Figure 16:
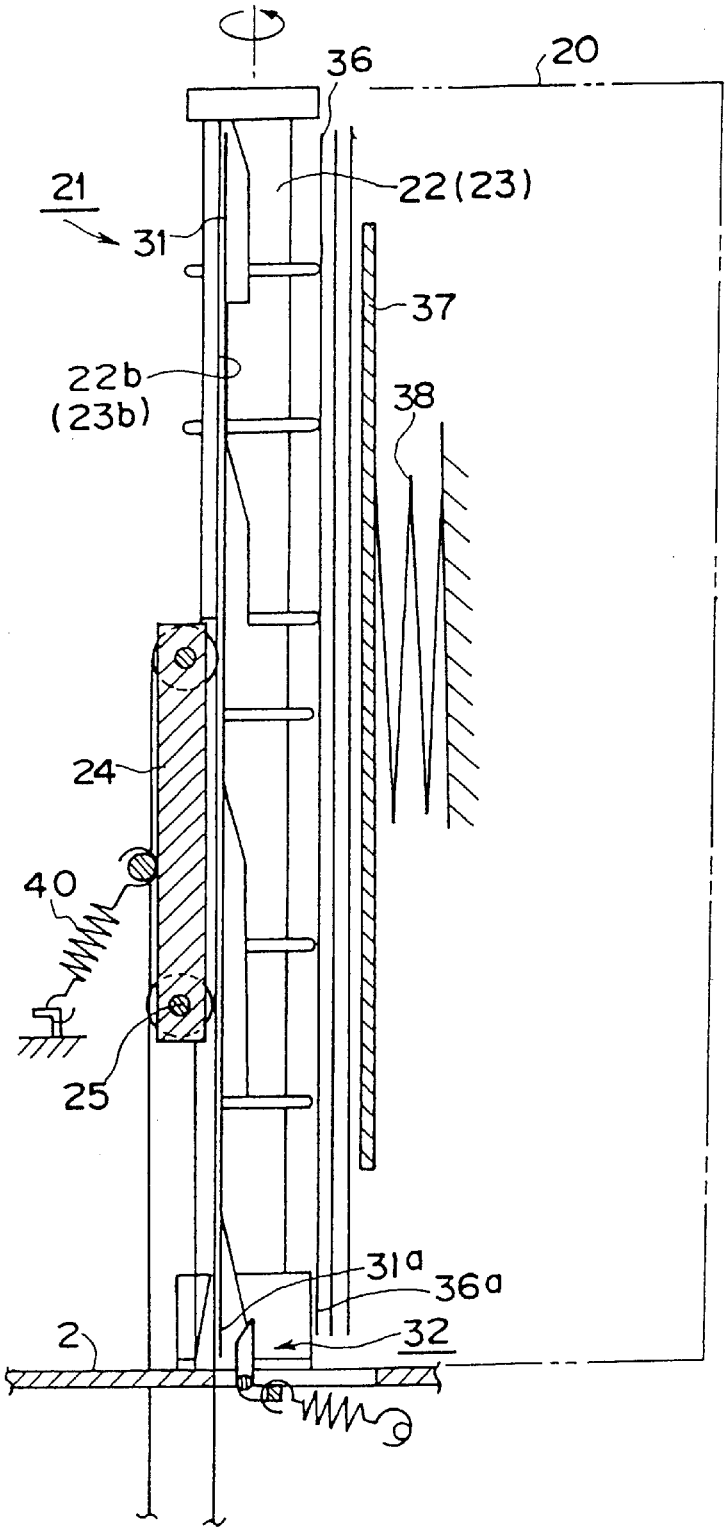
FIG. 16 is a conceptual side view depicting a function of the conventional bank-note shifting means.
Figure 17:
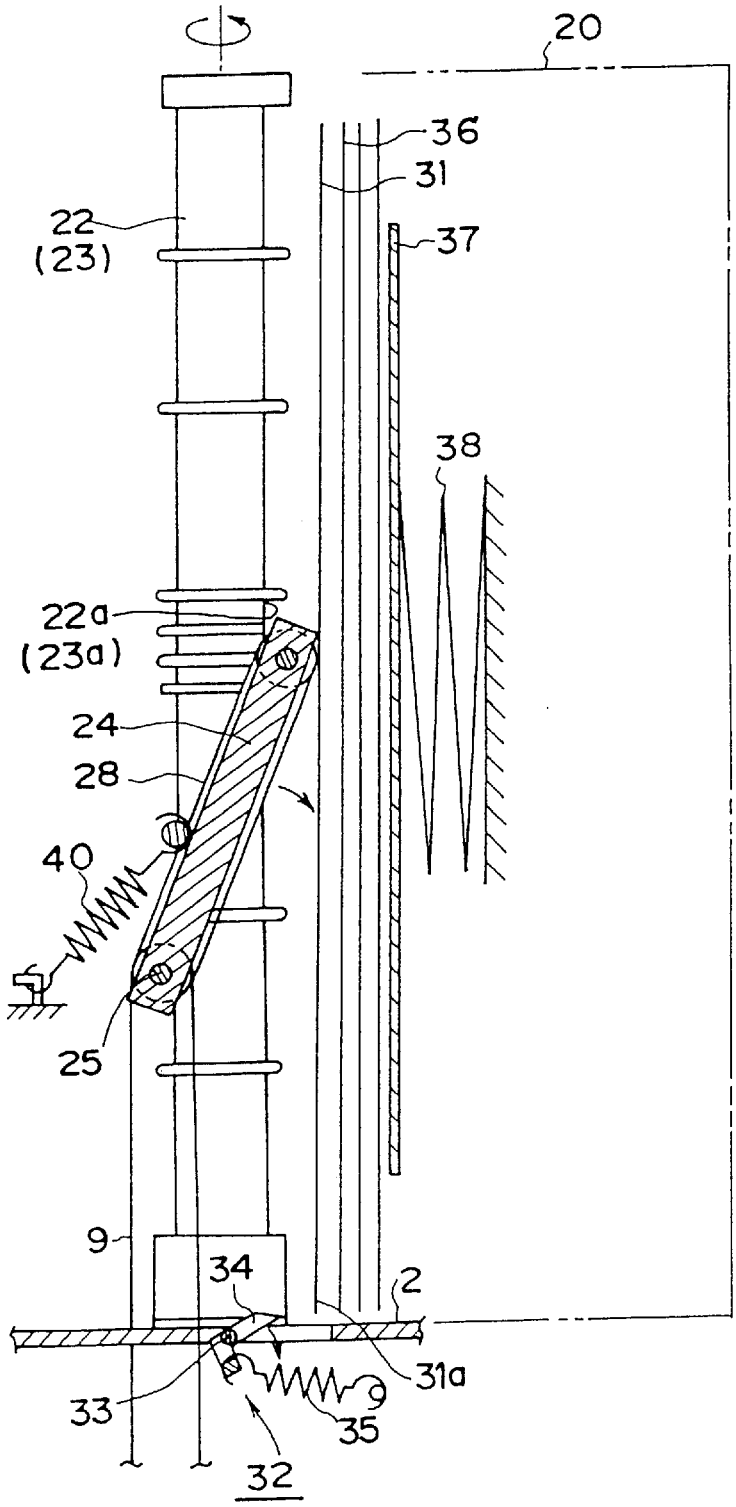
FIG. 17 is a conceptual side view depicting a function of the conventional bank-note shifting means.
Figure 18:
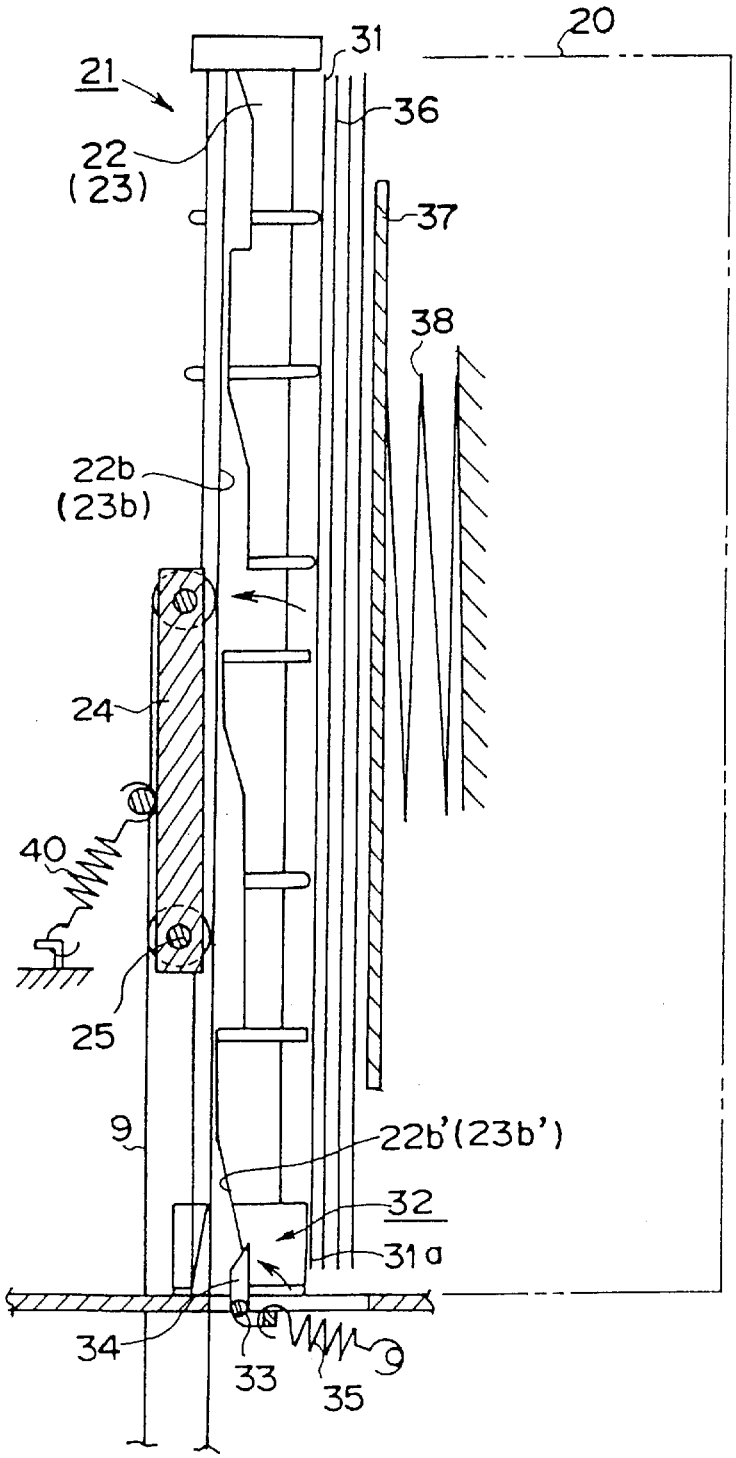
FIG. 18 is a conceptual side view depicting a function of the conventional bank-note shifting means.
Figure 19:
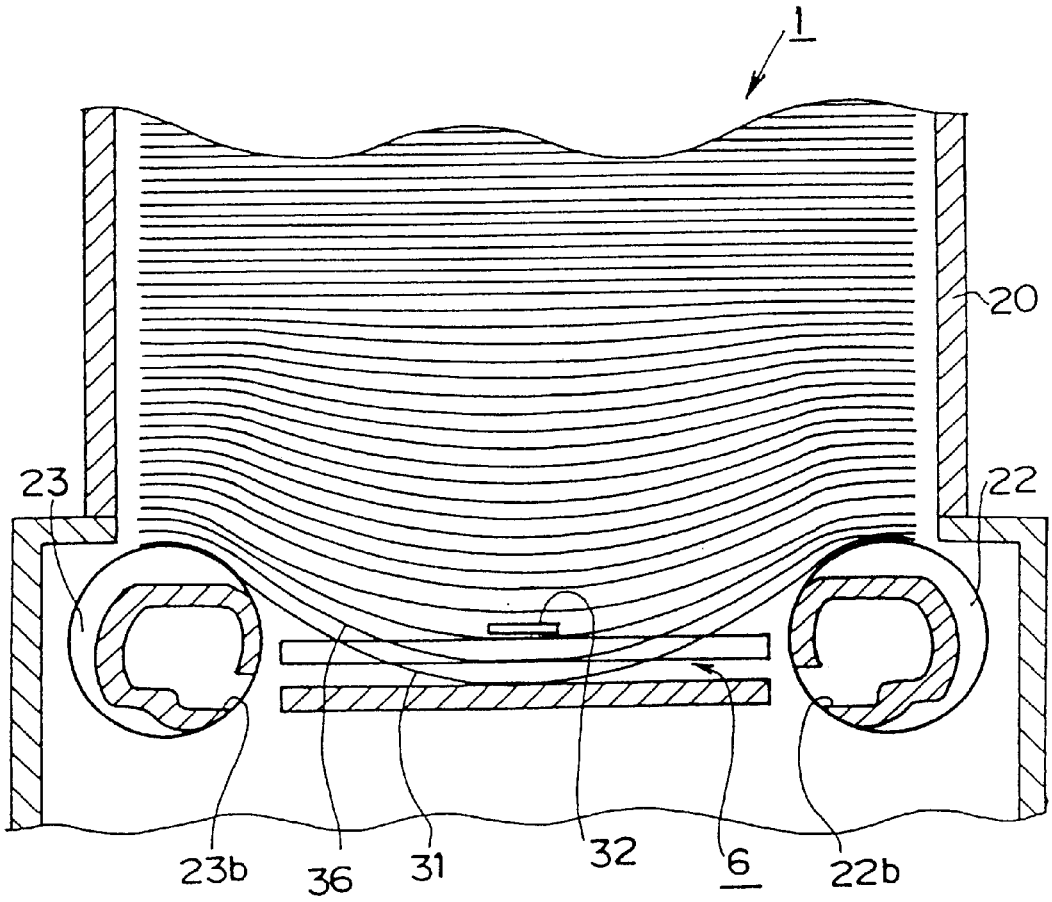
FIG. 19 is a conceptual cross-sectional view of a stacker depicting a function of the conventional bank-note shifting means.
Figure 20:
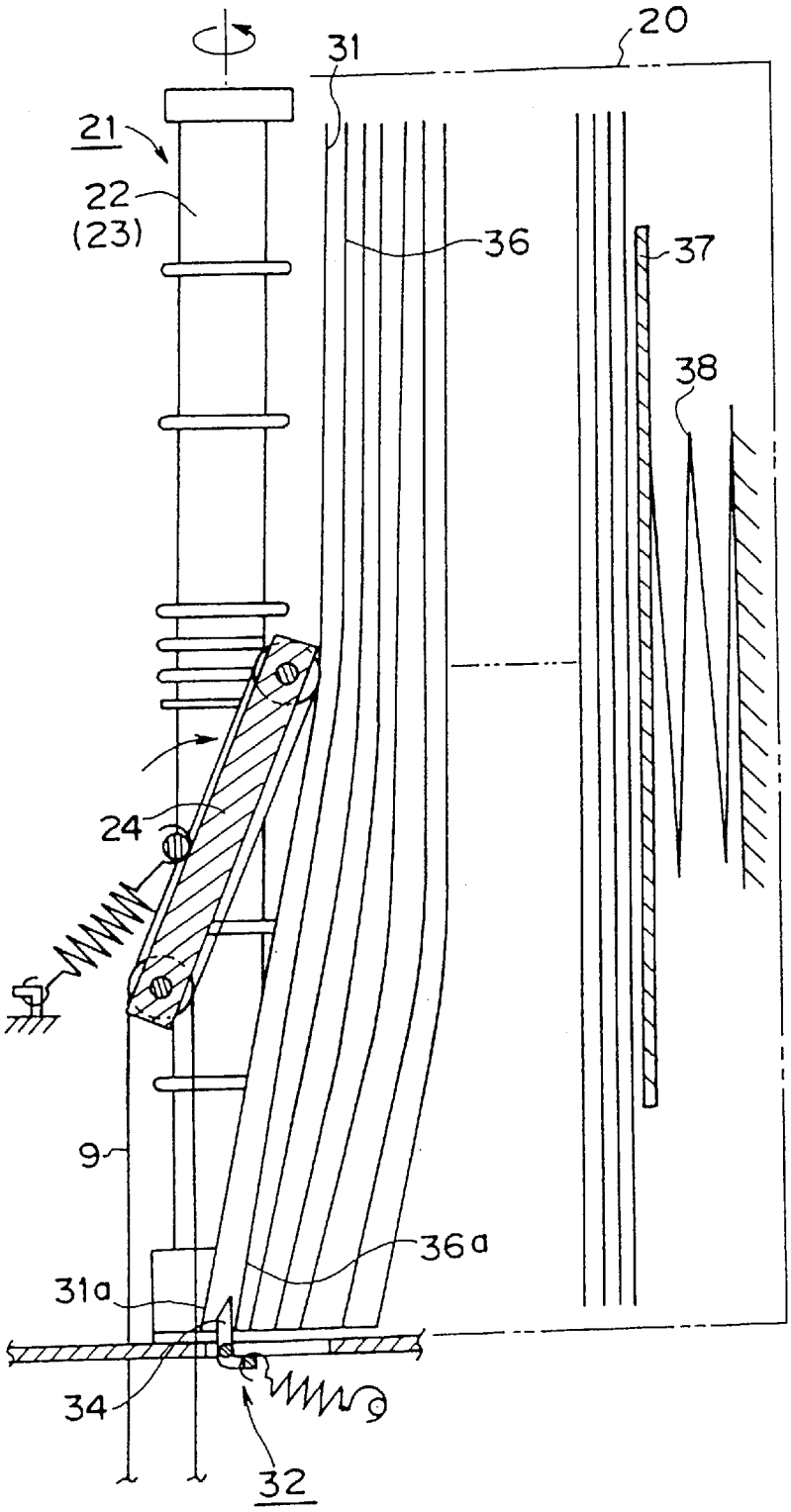
FIG. 20 is a conceptual side view depicting a function of the conventional bank-note shifting means.
Figure 21:
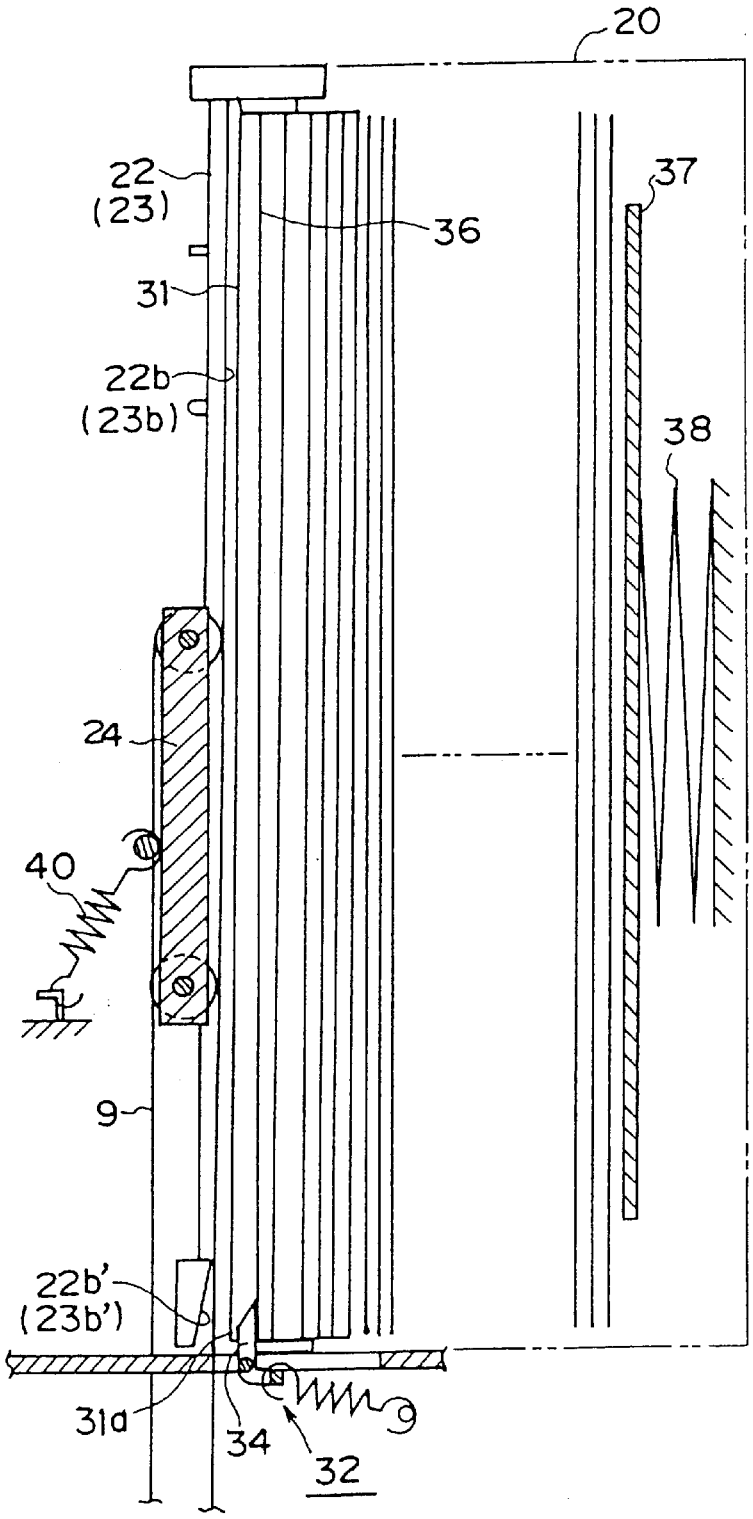
FIG. 21 is a conceptual side view depicting a function of the conventional bank-note shifting means.

FIG. 2 is a plan view of the bank-note shifting means 21 in accordance with the first aspect of the present invention viewed from the DD direction in FIG. 1, where identical parts as FIG. 14 are denoted with the same numerals.

This bank-note shifting means 21 in accordance with the first aspect of the present invention comprises a pair of rotary drums 22 and 23, which are disposed at a predetermined space (space slightly wider than the width of the bank-notes to be handled), a pair of engaging protrusions 51*a* and 51*b*, which engage with the engaging concave portions 22*a* and 23*a* formed at the center area of the pair of rotary drums 22 and 23, and a stacker chute 51, which rotates at a predetermined angle to the vertical direction in the drawing with a shaft 25 as a center when the rotary drums 22 and 23 make one turn, just like the prior art.

On both sides of the shaft 25, which rotatably supports the stacker chute 51, neither the pair of pulleys 26 where the pair of bank-note transporting belts 9 loop, nor the pair of the bank-note transporting belts 28, nor the pair of pulleys 30 where this pair of bank-note supporting belts 28 loop, are disposed, unlike the prior art in FIG. 14, and the shaft 29 which rotatably supports this pair of pulleys 30 is not disposed on the stacker chute 51 either, making the structure of the stacker chute 51 extremely simple.

At the lower part of the stacker chute 51, a stacker lever 53, which rotates for a predetermined angle in the vertical direction in the drawing with the shaft 52 supported at a part of the main body 2 as a center, interlocking with the movement of the stacker chute 51, is disposed.

In this embodiment, a pair of pulleys 54 are supported at both ends of the above mentioned shaft 52, which rotatably supports the stacker lever 53, and one end of the bank-note transporting belts 9, which are major components of the bank-note transporting means, loop the pulleys 54 respectively.

This stacker lever 53 and the above stacker chute 51 are formed on the shaft-shaped cam 55 supported at the center area of the stacker chute 51 and the stacker lever 53 at a position facing the cam 55, and are engaged with each other via the link mechanism 56 comprised of a cam groove 53*a* for inserting the cam 55, as shown in the EE conceptual cross-sectional view shown in FIG. 2.

The bottom end 53*b* of the stacker lever 53 reaches the position which exceeds the tip of the bank-note reverse-flowing-preventive lever 32, as shown in FIG. 2, and a notch 53*c* is formed at a position facing the bank-note reverse-flowing-preventive lever 32, so that the bottom end 53*b* of the stacker lever 53 does not contact with the bank-note reverse-flowing-preventive lever 32.

At the tip of the stacker chute 51, a pair of rollers 60, made of such synthetic resin as rubber with a relatively large coefficient of friction, are rotatably supported via shafts 61. The function of these rollers 60 will be described later.

Now the function of the above mentioned stacker lever 53 will be explained.

Figure 3:
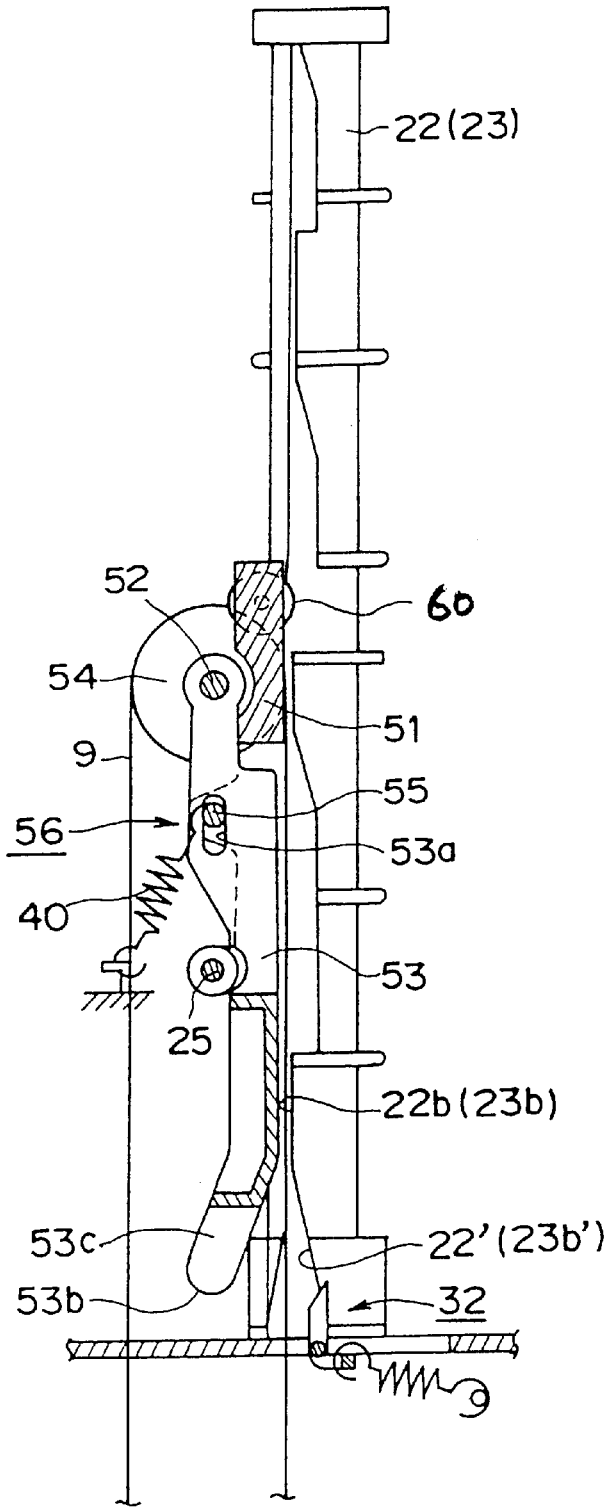
FIG. 3 is a conceptual side view of the bank-note shifting means in accordance with the present invention.
Figure 4:
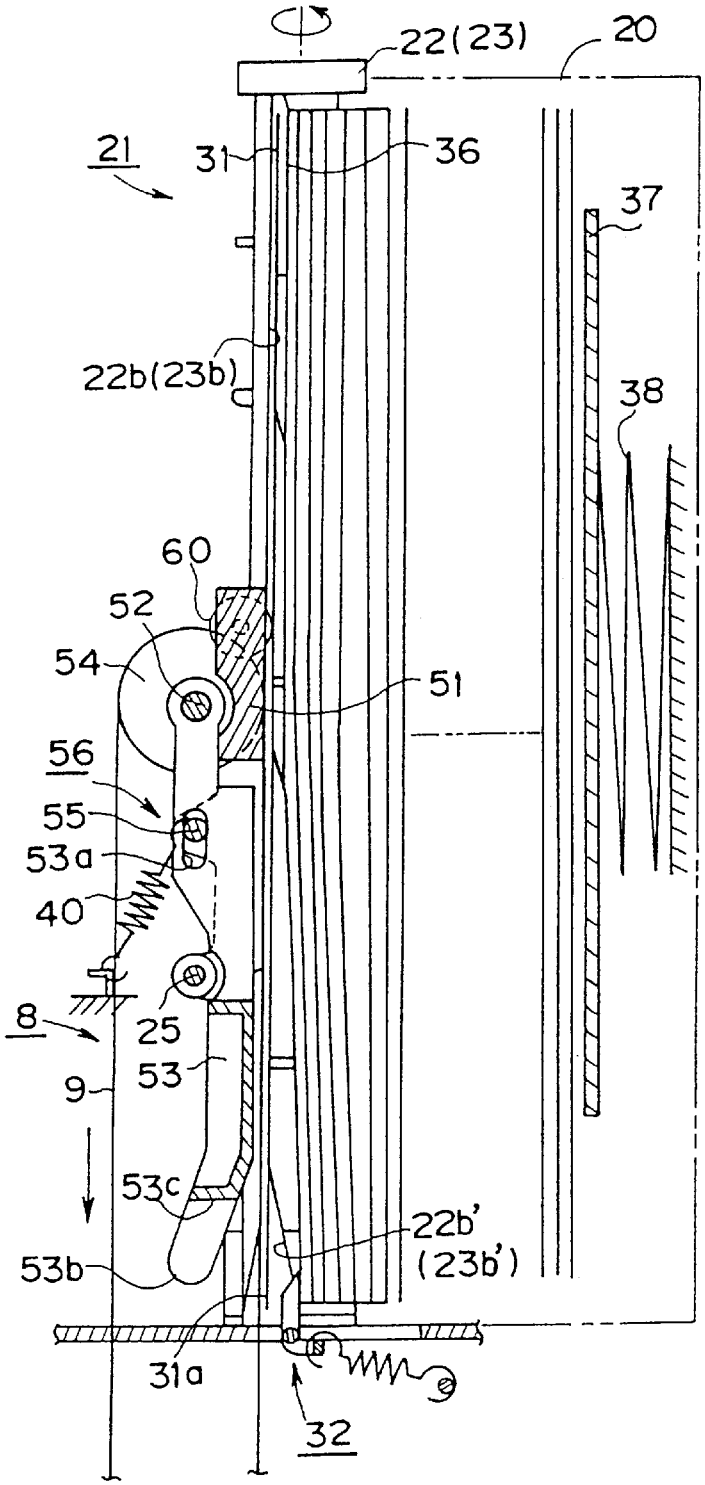
FIG. 4 is a conceptual side view depicting a function of the bank-note shifting means in accordance with the present invention.

FIG. 4 is a conceptual side view of the bank-note shifting means 21 depicting the function of the stacker lever 53, where identical parts as FIG. 3 are denoted by the same numerals, and particularly shows a state when a large number of wrinkled bank-notes 36 are stored by which the center area of the stored bank-notes 36 considerably swell in the width direction toward the pair of rotary drums 22 and 23.

In the state shown in FIG. 4, when an inserted bank-note 31, including the rear end 31*a*, is inserted in the bank-note guide slits 22*b* and 23*b* of the pair of rotary drums 22 and 23 via the bank-note transporting belt 9 of the bank-note transporting means 8, the pair of rotary drums 22 and 23 start rotation in directions opposite from each other at a same phase as shown in the arrow direction from the initial positions shown in FIG. 4 via the later mentioned driving means, such as a motor, based on the detection signal of the detection means, not illustrated here, which detects the inserted bank-note. Then the inserted bank-note 31 inserted in the bank-note guide slits 22*b* and 23*b* of the rotary drums 22 and 23 parallel shifts to the stacker 20 side, interlocking with the rotational movement of each bank-note guide slits 22*b* and 23*b*.

Figure 5:
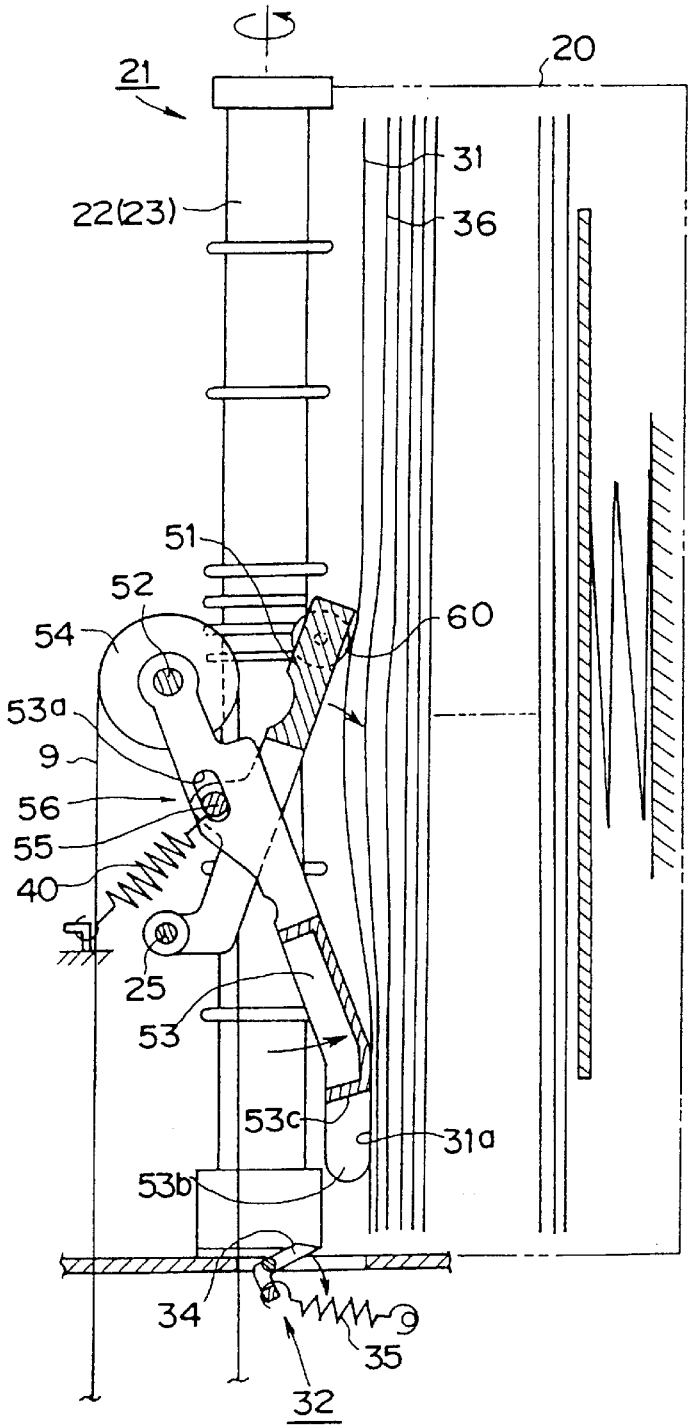
FIG. 5 is a conceptual side view depicting a function of the bank-note shifting means in accordance with the present invention.

At the same time, with the rotation of the pair of drums 22 and 23, the engaging concave portions 22*a* and 23*a* (FIG. 2) of the pair of rotary drums (FIG. 2) also rotate, so the stacker chute 51 also rotates clockwise with the shaft 25 at the center, as shown in FIG. 5, via the pair of engaging protrusions 51*a* and 51*b* (FIG. 2) engaged with the engaging concave portions 22*a* and 23*a*.

When the stacker chute 51 rotates clockwise with the shaft 25 as the center like this, a pair of rollers 60 disposed at the tip of the stacker chute 51 press the rear face of the center area of the inserted bank-note 31, which is stored in the bank-note guide slits 22*b* and 23*b*, and pushes the inserted bank-note 31 out of the bank-note guide slits 22*b* and 23*b* toward the stacker 20 in parallel.

The above mentioned pair of rollers 60 press the rear face at the center area of the inserted bank-note 31, and block the bank-note 31 from moving in the width direction.

When the stacker chute 51 rotates clockwise with the shaft 25 as the center, the stacker lever 53 also rotates counterclockwise with the shaft 52 as the center, as shown in FIG. 5, strongly pressing the bottom end 31*a* of the inserted bank-note 31, and pushes the bank-note 31 toward the stacker 20 side in parallel by the function of the link mechanism 56 comprised of the cam 55 and the cam groove 53*a* for engaging this stacker chute 51, and the stacker lever 53. When the stacker lever 53 rotates counterclockwise, the tip 53*b* reaches the position which exceeds the outer surfaces of the pair of rotary drums 22 and 23, so during this time, the bottom end 31*a* of the inserted bank-note 31 contacts the tip of the roughly L-shaped lever 34 constituting the bank-note reverse-flowing-preventive lever 32, then reaches a position which exceeds the tip of the roughly L-shaped lever 34, that is, a position which exceeds the outer surfaces of the pair of rotary drums 22 and 23 without fail.

Then the lever 34 of the bank-note reverse-flowing-preventive lever 32, which contacts with the bottom end 31*a* of the inserted bank-note is cleared, quickly returns to the initial position by the exerted force of the return spring 35.

Figure 6:
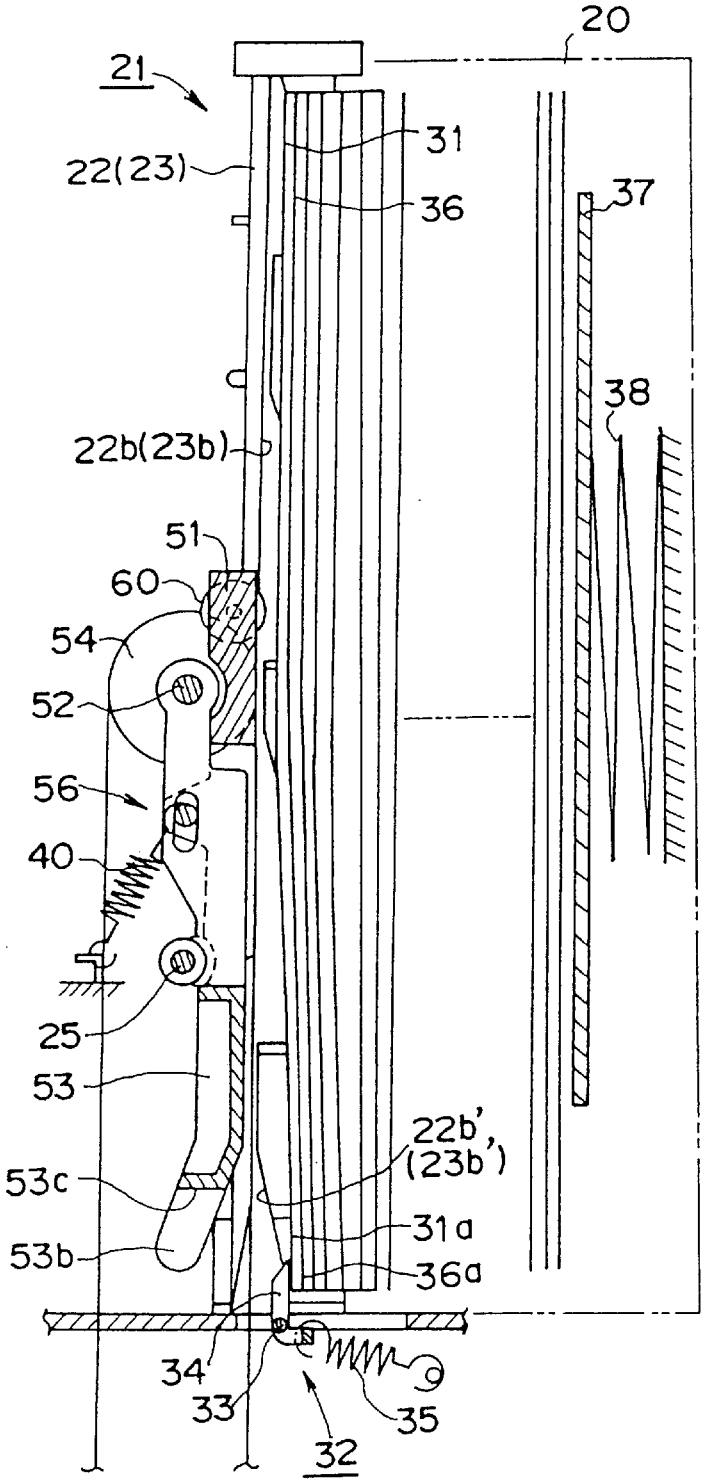
FIG. 6 a conceptual side view depicting a function of the bank-note shifting means in accordance with the present invention.

When the rotary drums 22 and 23 make one turn and return to the initial positions shown in FIG. 6, on the other hand, the stacker chute 51 as well rotates counterclockwise with the shaft 25 as the center and returns to the initial position by the exerting force of the return spring 35.

When this stacker chute 51 returns to the initial position in FIG. 6, the stacker lever 53 also rotates clockwise with the shaft 52 as the center, and returns to the initial position by the function of the link mechanism 56, therefore the entire bank-note shifting means 21 returns to the standby position where the next bank-note is inserted to the bank-note guide slits 22*b* and 23*b*.

Figure 7:
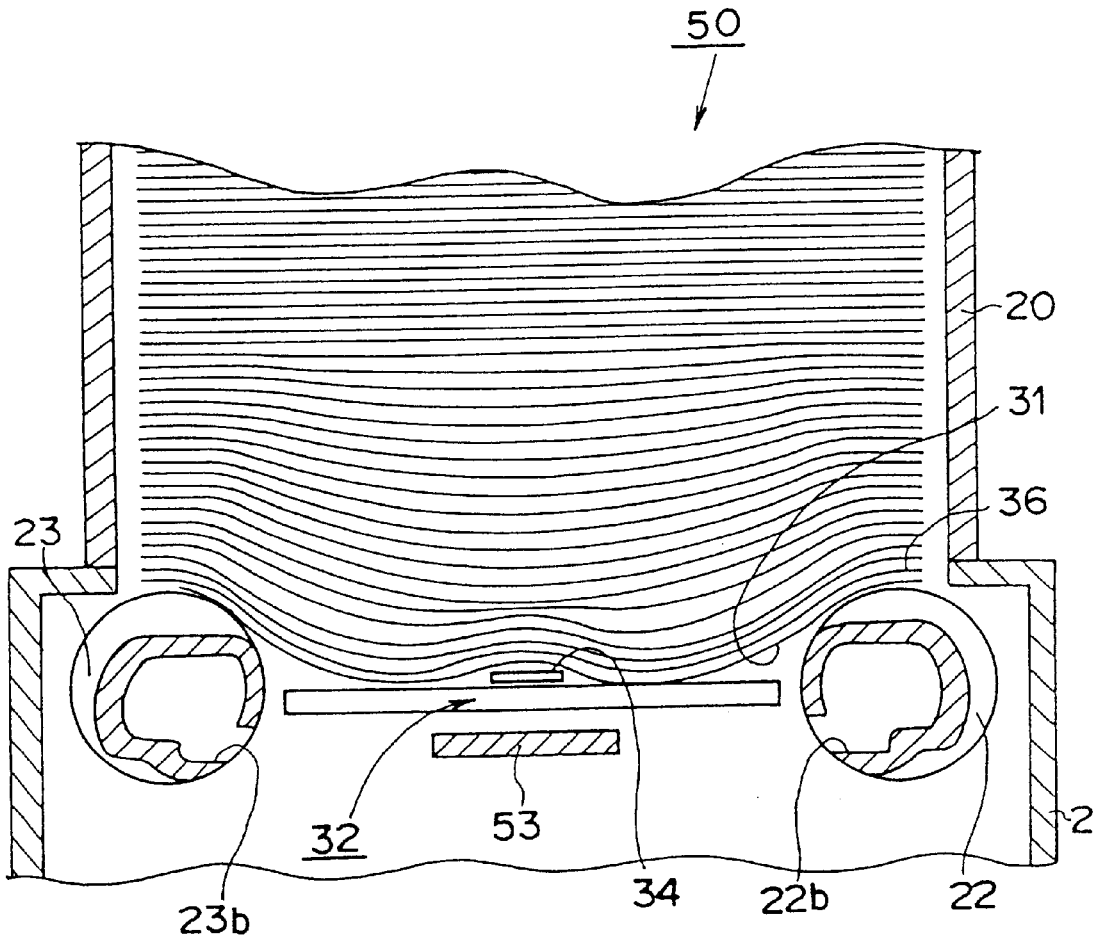
FIG. 7 is a conceptual cross-sectional view depicting a function of the bank-note shifting means in accordance with the present invention.

When the stacker lever 53 returns to the initial position, the large number of bank-notes 36, where the center area in the width direction is swelled, and the bank-note 31, which is parallel shifted, are pushed back to the area between the pair of rotary drums 22 and 23 by resilience, but the bottom ends 36*a* and 31*a* of the bank-notes 36 and 31 have been moved to a position which exceeds the tip of the roughly L-shaped lever 34 constituting the bank-note reverse-flowing-preventive lever 32 by the tip 53*b* of the stacker lever 53 rotated counterclockwise as shown in FIG. 5, therefore even if the bottom ends 36*a* and 31*a* of the bank-notes 36 and 31 are pushed back toward the area between the pair of rotary drums 22 and 23, the pushed back bank-notes 31 and 36 are engaged in the rear face of the roughly L-shaped lever 34 constituting the bank-note reverse-flowing-preventive lever 32 without fail, and stop there as shown in FIG. 6 and the cross-sectional view of the major portion of the bank-note processing device 1 in FIG. 7, and do not enter the leading ends 22*b*' and 23*b*' side (FIG. 6) of the bank-note guide slits 22*b* and 23*b* formed on the rotary drums from there.

As a consequence, even in a state where a large number of wrinkled bank-notes 36 are stored by which the center area of the stored bank-notes in the width direction is swelled, the bottom ends 31*a* and 36*b* are completely prevented from moving into the leading ends 22*b*' and 23*b*' of the bank-note guide slits 22*b* and 23*b* by the roughly L-shaped lever 34 constituting the bank-note reverse-flowing-preventive lever 36, therefore the leading ends 22*b*'and 23*b*' of the bank-note guide slits 22*b* and 23*b* formed on the rotary drums 22 and 23 are constantly open (FIG. 6), which makes it easy to smoothly insert the next inserted bank-note into the bank-note guide slits 22*b* and 23*b* of the rotary drums 22 and 23, and as a result, collision of the stored bank-notes and the bank-note to be stored in the bank-note guide slits 22*b* and 23*b* can be avoided, and bank-note jamming can be prevented as much as possible.

Regarding the bank-note transporting means which transports an inserted bank-note along the L-shaped bank-note transporting route 6 upstream thereof via the bank-note guide slits 22*b* and 23*b* of the pair of rotary drums 22 and 23 in accordance with a second aspect of the present invention pointed out in (2) above, the difference in structure between the conventional bank-note processing device 1 and the bank-note processing device 50 of the present embodiment will now be described.

In the case of the bank-note transporting means 8 of the prior art shown in FIG. 14, a pair of pulleys 26 and 27, where a pair of bank-note transporting belts 9 are looped, are secured on both sides of the shaft 25 which rotatably supports the stacker chute 24, another pair of bank-note transporting belts 28 loop the pair of pulleys 27, and the other ends of the pair of bank-note transporting belts 28 loop a pair of pulleys 30, which are supported by both ends of the shaft 29 disposed at the tip of the stacker chute 24, and this complicated structure with numerous parts becomes the cause of a cost increase in manufacturing.

The reasons why the pair of pulleys 26 and 27 are secured on both sides of the shaft 25 which supports the stacker chute 24 and the pair of bank-note transporting belts 28 loop the pair of pulleys 27, as in the prior art shown in FIG. 14, is that an inserted bank-note 31 is transported upstream of the bank-note guide slits 22*b* and 23*b* by this pair of bank-note transporting belts 28, and also that the pair of bank-note transporting belts 28 are pressed against the rear face of the inserted bank-note 31 when the stacker chute 24 is rotated counterclockwise with the shaft 25 as the center, so that moving the inserted bank-note 31 to the width direction is prevented when the inserted bank-note 31 is parallel shifted to the stacker 20 side, and the inserted bank-note 31 in the stacker 20 is loaded and stored accurately.

Unlike this bank-note transporting means 8 of the prior art, the bank-note transporting means 8 applied to the bank-note processing device 50 of the embodiment in accordance with the second aspect of the present invention has only a pair of bank-note transporting belts 9, as shown in FIG. 1 and FIG. 2, and one end of the bank-note transporting belts 9 merely loop the pair of pulleys 54 supported by the shaft 52 at the tip of the stacker chute 51, therefore the structure is extremely simple compared with the prior art shown in FIG. 14. Since the pulleys 54 shown in FIG. 1 and FIG. 2 are disposed at the tip of the stacker chute 51, an inserted bank-note 31 can be transported upstream of the bank-note guide slits 22*b* and 23*b*, just like the case of the prior art.

In the bank-note processing device 50 of the present invention, a pair of rollers 60 are disposed at the tip of the stacker chute 51, as mentioned above, and this pair of rollers 60 press the rear face at the center area of the inserted bank-note 31 stored in the bank-note guide slits 22*a* and 23*b* so that the movement of inserted bank-notes 31 to the width direction of the bank-note 31 is prevented when the inserted bank-note 31 parallel shifts from the bank-note guide slits 22*b* and 23*b* to the stacker 20 side, therefore the inserted bank-note 31 can be loaded and stored in the stacker 20 accurately, just like the prior art. Also compared with the prior art, the bank-note transporting means with a much simpler structure using few number of parts can be provided, so with the bank-note processing device 50 of the present invention, the manufacturing steps and manufacturing cost can be decreased considerably. Here one pair of rollers 60 were disposed at the tip of the stacker chute 51, as shown in FIG. 2, but the number of rollers 60 may be only one, the number is not restricted.

Now regarding the structure of the driving device for driving the pair of rotary drums 22 and 23 which are the major components of the bank-note shifting means 21, as pointed out in (3) above, the difference between the conventional bank-note processing device 1 and the bank-note processing device 50 of the present embodiment will be described.

As FIG. 1 shows, in this bank-note processing device 50, the drive device 65 for driving the rotation of the pair of rotary drums 22 and 23, which are the major components of the bank-note shifting means 21, are disposed at the upper part inside the main body 2.

Figure 8:
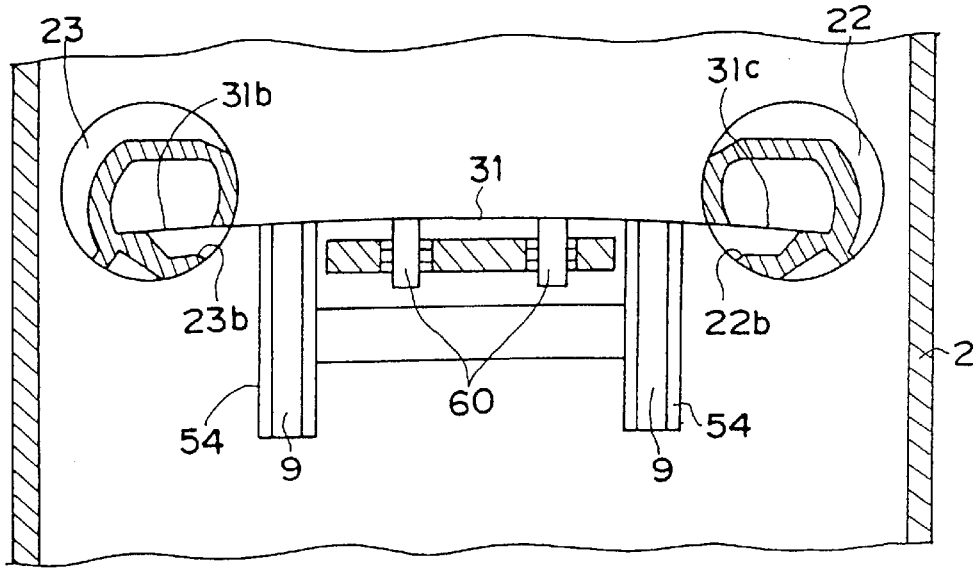
FIG. 8 is a cross-sectional view of a major portion of the bank-note-processing unit in accordance with the present invention.

On the other hand, in this bank-note processing device 50, the inserted bank-note 31 is transported upstream of the bank-note guide slits 22*b* and 23*b* along the bank-note guide slits 22*b* and 23*b* formed on the cylindrical surfaces of the pair of rotary drums 22 and 23 using the transporting force of the pair of bank-note transporting belts 9 of the bank-note transporting means 8, as mentioned above, and in order to transport the bank-note 31 inserted in the bank-note guide slits 22*b* and 23*b* upstream of the bank-note guide slits 22*b* and 23*b* along the bank-note guide slits 22*b* and 23*b*, as shown in FIG. 8, which is the conceptual enlarged HH cross-sectional view in FIG. 2, both ends 3*b* and 31*c* of the bank-note 31 inserted into the bank-note guide slits 22*b* and 23*b* must be pressed against the pair of bank-note transporting belt 9 side by the bank-note guide slits 22*b* and 23*b*, so as to secure a friction force between the inserted bank-note 31 and the bank-note transporting belt 9. For this, the pair of rotary drums 22 and 23 must be positioned and stopped so that the bank-note guide slits 22*b* and 23*b* come to the position shown in FIG. 8, that is, both ends 3*b* and 31*c* of the inserted bank-note 31 comes to the position where both ends 31*b* and 31*c* of the inserted bank-note 31 are pressed against the pair of bank-note transporting belt 9 sides.

Needless to say, the conventional bank-note processing device 1 also controls the rotation stop position of driving means, such as a motor, for driving the pair of rotary drums 22 and 23, so that the bank-note guide slits 22*b* and 23*b* are positioned at the position shown in FIG. 8.

However, the conventional driving means for driving the pair of rotary drums 22 and 23 is comprised of a motor and power transfer means, such as a gear, for transferring the drive force of the motor to the pair of rotary drums 22 and 23, therefore an error easily occurs to the stopping position of the pair of rotary drums 22 and 23 due to such environmental conditions as temperature and the dispersion of machine load.

If an error occurs to the stopping position of the pair of rotary drums 22 and 23, the force pressing the inserted bank-note 31 against the bank-note transporting belt 9 become unstable, which decreases the friction force between the inserted bank-note 31 and the bank-note transporting belt 9, causing such problems as bank-note transporting failure.

In FIG. 8 in particular, if one rotary drum 22 of the pair of rotary drums 22 and 23 slightly turns clockwise from the position in FIG. 8 and the other rotary drum 23 slightly turns counterclockwise, then pressing on both ends 31*b* and 31*c* of the inserted bank-note 31 by the bank-note guide slits 22*b* and 23*b* cannot function, which causes the inserted bank-notes 31 to float from the bank-note transporting belt 9, which considerably drops the transporting force of the bank-note transporting belt 9 for the inserted bank-note 31, causing bank-note transporting errors.

So in the bank-note processing device 50 of the present invention, to minimize the above mentioned bank-note transporting errors, a brake means is included in the driving means 65 (FIG. 1) for driving the pair of rotary drums 22 and 23, so that the pair of rotary drums 22 and 23, stopped at the predetermined positions, will not rotate in one direction respectively (direction where the pressing on both ends 31*b* and 31*c* of the inserted bank-note 31 by the bank-note guide slits 22*b* and 23*b* does not function).

Figure 9:
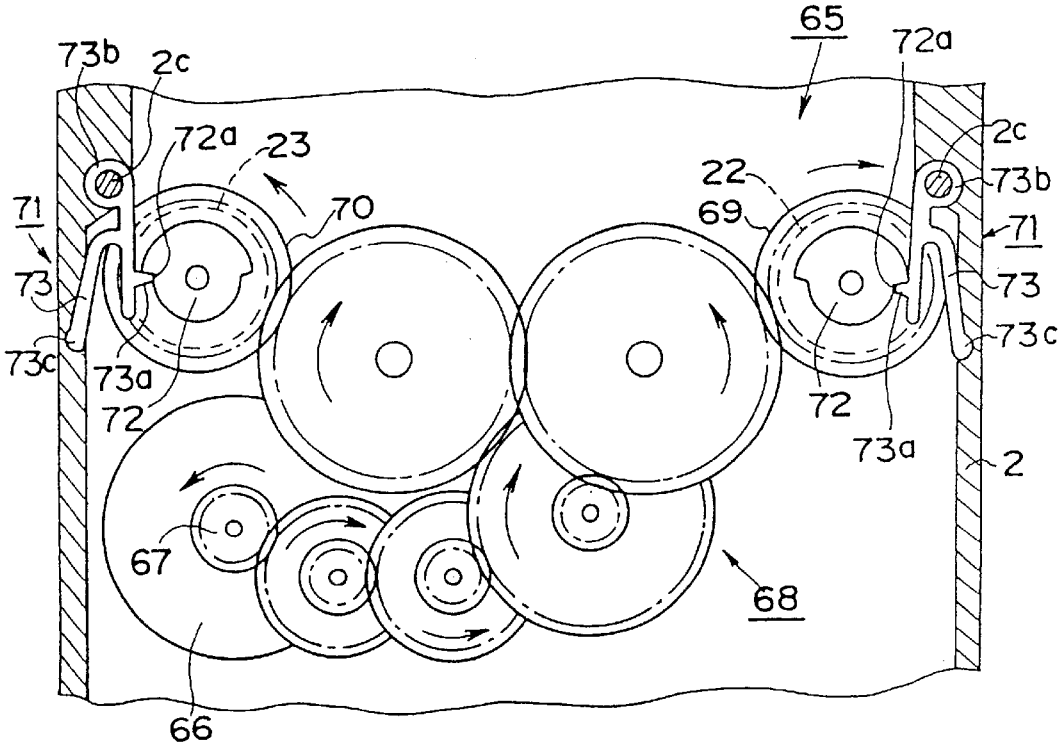
FIG. 9 is a cross-sectional view of a major portion of a driving device for driving the rotary drums applied to the bank-note processing device in accordance with the present invention.

FIG. 9 is a conceptual enlarged plan view of the driving means 65 for driving the pair of rotary drums 22 and 23 to be used for the bank-note-processing unit 50 of the embodiment.

This driving means 65 comprises a gear deceleration device 68 comprised of a plurality of gears which decelerates the rotation of the pinion which is secured on the driving shaft of the motor 66 of the driving means 65, and transfers the driving force to the pair of rotary drums 22 and 23.

In this gear deceleration device 68, brake means 71 is disposed on the gears 69 and 70 at the final step respectively, which are directly connected to the pair of rotary drums 22 and 23 and directly drive the rotation of the rotary drums 22 and 23, so that when the rotation driving of each gear 69 and 70 by the motor 66 stops, the brake means 71 prevents each rotary drum 22 and 23 from rotating in one direction from these stop positions.

This brake means 71 is secured to the top face of the gears 69 and 70 at the final step respectively, rotates along with the gears 69 and 70, and is comprised of a rotation cam 72 which has a large step difference 72 on the surface, and a spring 73 having a stopper latch 73*a* which is pressed against the cylindrical surface of the rotation cam 72. The spring 73 is formed by synthetic resin to be roughly L-shaped when seen in the cross-section, and one end 73*b* of the spring 73 is inserted into the protrusion 2*c* formed at a part of the main body 2, and the other end 73*b* engages with a pin 2*c* which sticks out from the cylindrical surface of the main body 2, and is supported at this position.

According to such brake means 71, the step difference 72*a* of each rotation cam 72 engages with the stopper latch 73*a* of each spring 73 when the rotation of each gear 69 and 70 stops, therefore one rotary drum 22 of the pair of rotary drums 22 and 23 is prevented from rotating to the clockwise direction, and the other rotary drum 23 is prevented from rotating to the counterclockwise direction.

Because of this, the pair of rotary drums 22 and 23 stop at the position where both ends 31*a* and 31*b* of the inserted bank-note 31 inserted into the bank-note guide slits 22*b* and 23*b* are pressed against the pair of bank-note transporting belts 9 by the bank-note guide slits 22*b* and 23*b* without fail, as shown in FIG. 8, and by this, contact between the inserted bank-note 31 and the bank-note transporting belt 9 is insured while maintaining the state where the friction force is received from the bank-note transporting belt 9.

As a consequence, the inserted bank-note 31 is pressed against the pair of bank-note transporting belts 9 of the bank-note transporting means 8 by the bank-note guide slits 22*b* and 23*b*, by which the inserted bank-note 31 is stably transported upstream of the bank-note guide slits 22*b* and 23*b* with an appropriate friction force.

Now regarding the structure of the shutter means 8 for opening/closing the bank-note transporting route 6 in accordance with the third aspect of the present invention pointed out in (4) above, the difference of the structure between the conventional bank-note processing device 1 and the bank-note processing device 50 of this embodiment will be described.

In the shutter means 7 of the conventional bank-note processing device 1, the pinion formed on the driving shaft of the motor, not illustrated here, is engaged with the rack disposed at the rear end of the shutter 7*a*, and this pinion is driven and rotated by the motor, as described above, so that the shutter 7*a* is moved in the horizontal direction shown by the arrow mark A, by which the bank-note transporting route 6 is opened/closed.

Since the conventional bank-note processing device 1 uses the pinion and rack as a driving device for opening/closing the shutter 7*a*, the rotation direction of the pinion is the opposite when the shutter 7*a* is moved to the right direction, as shown in FIG. 13, to close the bank-note transporting route 6, and when the shutter 7*a* is moved to the left direction, as shown in FIG. 13, to open the bank-note transporting route 6.

This means that the rotation direction of the motor for driving the pinion must be changed as well, therefore the open/close control of the shutter 7*a* is difficult, and if the sensor, not illustrated here, for detecting the closing of the bank-note transporting route 6 by the shutter 7*a* fails, the closing of the bank-note transporting route 6 by the shutter 7*a* cannot be detected, the pinion continues rotating in the shutter closing direction, and as a result, the shutter 7*a* and the chute constituting the bank-note transporting route 6 contact, locking the shutter 7*a*, which will damage the shutter means 7 itself.

Figure 10:
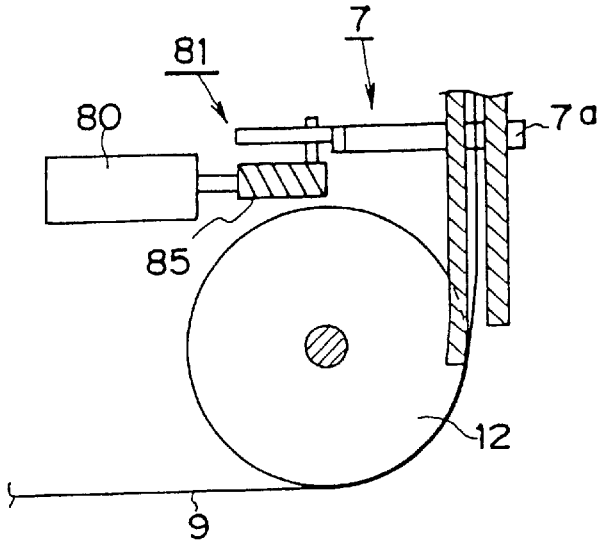
FIG. 10 is an enlarged view of a major portion in FIG. 1, depicting the shutter means applied to the bank-note processing device in accordance with the present invention.

In the bank-note processing device 50 of the present invention, on the other hand, the shutter 7*a* constituting the shutter means 7 comprises the motor 80 disposed at the rear end of the shutter 7*a*, and the crank mechanism 81 which converts the rotational driving force of the motor 80 in one direction to a reciprocating motion of the shutter 7*a* in the left and right directions, as shown in FIG. 10, which is a cross-sectional enlarged view of the major portion in FIG. 1.

Figure 11:
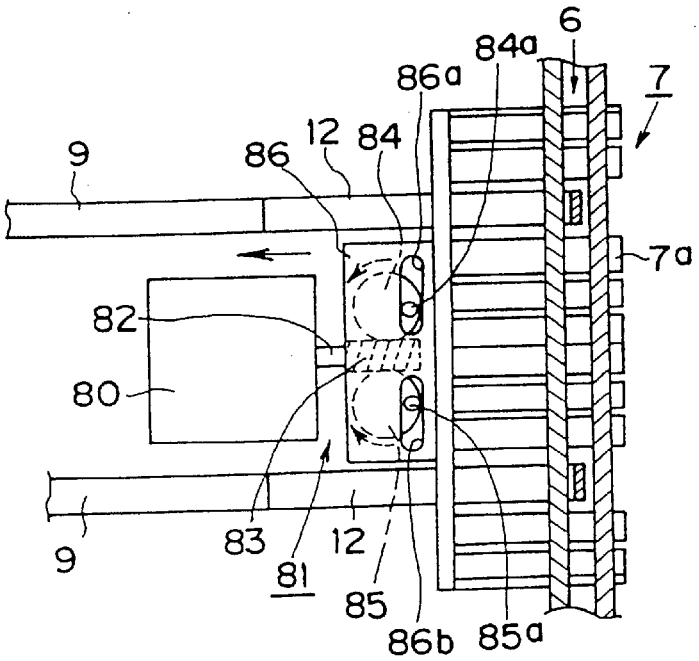
FIG. 11 is a conceptual plan view of the shutter means applied to the bank-note processing device in accordance with the present invention.

This crank mechanism 81 comprises a warm gear 83 secured at the tip of the driving shaft 82 of the motor 80, a pair of warm wheels 84 and 85 which are rotatably disposed on both sides of the warm gear 83 and which engage with the warm gear 83, and guide pins 84*a* and 85*a* protruding from the upper surface of the pair of warm wheels 84 and 85 respectively, as shown in FIG. 11, which is a top view of FIG. 10.

These guide pins 84*a* and 85*a* are inserted into the corresponding guide holes 86*a* and 86*b* formed on a slider piece 86. This slider piece 86 is disposed at the rear end of the shutter 7*a*, and the guide holes 86*a* and 86*b* are formed at symmetrical positions along the width direction of the slider piece 86.

Now the function of the shutter means 7 in accordance with the third aspect of the present invention will be explained.

As FIG. 10 shows, when a driving shaft 82 of the motor 80 rotates in one direction, the pair of warm wheels 84 and 85 engaging with the warm gear 83 rotate in directions which are opposite from each other, as shown by the arrow marks, via the warm gear 83.

Figure 12:
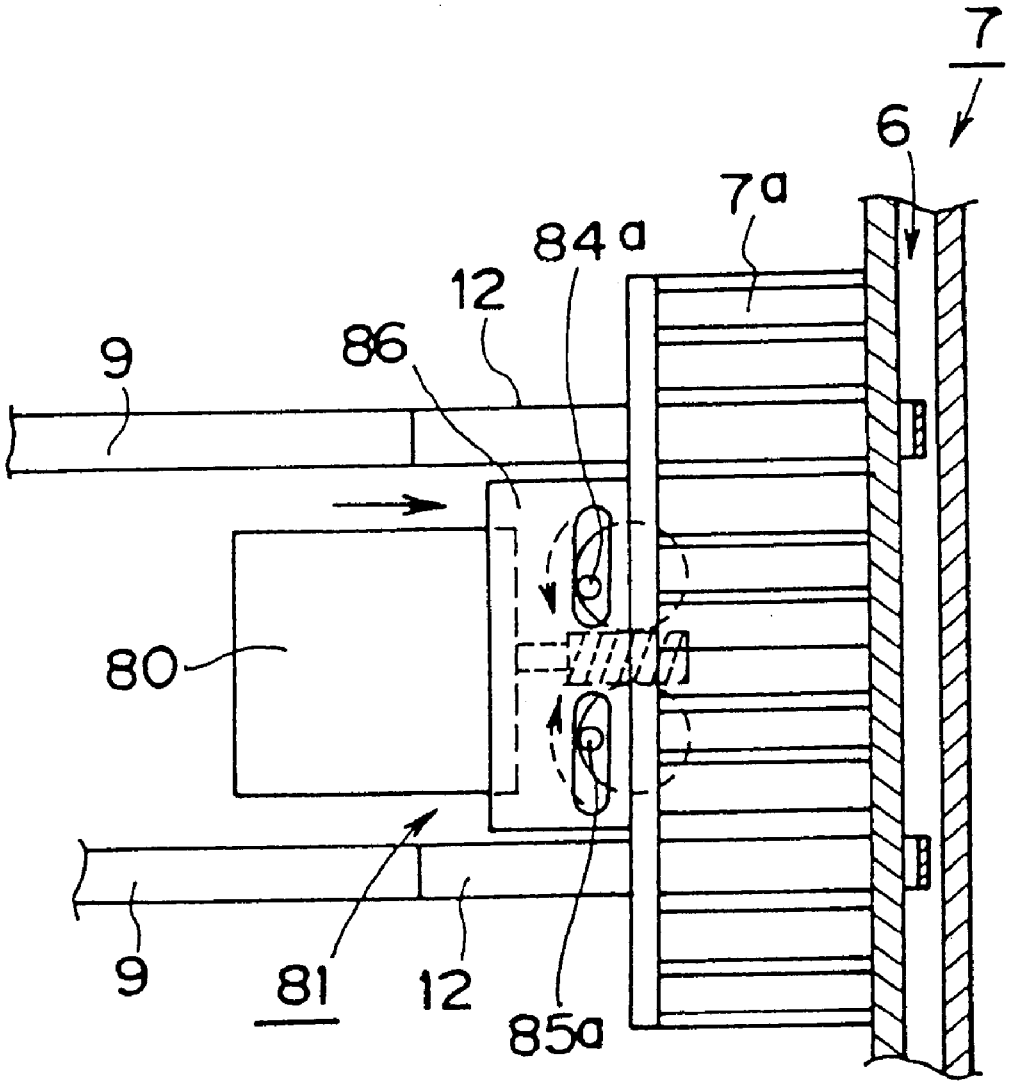
FIG. 12 is a conceptual plan view of the shutter means applied to the bank-note processing device in accordance with the present invention.

Then each guide pin 84*a* and 85*a* disposed on the top face of the pair of warm wheels 84 and 85 also rotate in opposite directions interlocking with the rotation of the pair of warm wheels 84 and 85, and by the guide holes 86*a* and 86*b* engaging with the rotating guide pins 84*a* and 85*a*, the shutter 7*a* performs reciprocating motions to the left and right via the slider piece 86*a*, moving from the initial position in FIG. 11, that is, the right end position in FIG. 11 closing the bank-note transporting route 6, to the left end position in FIG. 12, that is, the position opening the bank-note transporting route 6, and then back to the initial position in FIG. 11 again.

According to the above mentioned shutter means 7, when the driving shaft 82 of the motor 80 shown in FIG. 11 is rotated to one direction, the shutter 7*a* performs a reciprocating motion to the left and right for a predetermined distance to open/close the bank-note transporting route 6, which means that the control for the changing rotation direction of the motor for opening/closing the bank-note transporting route 6, required for the prior art, is unnecessary. Therefore the open/close control of the bank-note transporting route 6 is simple, and also even if the sensor for detecting the closing of the bank-note transporting route 6 by the shutter 7*a* fails and the motor continues moving, the shutter 7*a* merely performs the reciprocating motion to the left and right for a predetermined distance, so contact of the shutter 7*a* and the chute constituting the bank-note transporting route 6, causing the shutter 7*a* to lock and damage the shutter means 7 itself can be prevented as much as possible.

As explained above, according to the first aspect of the present invention, the stacker lever, which presses the portion positioned at the bank-note reverse-flowing-preventive lever side of the bank-note inserted into the bank-note guide slits and is pressed against the stacker side interlocking with the movement of the stacker chute, is disposed between the pair of rotary drums, so that the portion positioned at the bank-note reverse-flowing-preventive lever side of the bank-note inserted into the bank-note guide slits is parallel shifted into the stacker without fail, and the portion positioned at the bank-note reverse-flowing-preventive lever side of the bank-note is surely engaged with the bank-note reverse-flowing-preventive lever without returning to the bank-note guide slits side, therefore even if a large number of wrinkled bank-notes are stored in the stacker, the portion positioned at the bank-note reverse-flowing-preventive lever side of the bank-note will not stick out toward the bank-note guide slits side, because the next bank-note to be guided into the bank-note guide slits is smoothly guided, and as a result, a bank-note processing device which performs stable bank-note storing processing by avoiding the collision of bank-notes stored in the stacker and the bank-note to be stored next minimizing the occurrence of the jamming of bank-notes can be provided.

According to the second aspect of the invention, in the bank-note processing device comprised of the pair of rotary drums where the bank-note guide slits are formed on the cylindrical surfaces in a longitudinal direction, and the stacker chute for pushing the bank-note inserted into these bank-note guide slits toward the stacker side, the pair of pulleys are supported by the shaft disposed adjacent to the free end side of this stacker chute, and the pair of bank-note transporting belts stretched along the bank-note guide slits loop this pair of pulleys so that the inserted bank-note is transported along the bank-note guide slits, therefore the structure of the bank-note transporting means is simple with few parts, and the bank-note processing device for transporting a bank-note along the bank-note guide slits of the pair of rotary drums can be provided at low cost.

According to the third aspect of the present invention, the shutter means for opening/closing the bank-note transporting route is comprised of the slidable shutter and the crank mechanism for converting the rotational driving force of the motor in one direction to the reciprocating motion of the shutter, therefore the control for changing the rotational direction of the motor is not required at all for opening/closing the shutter, which makes the open/close control of the bank-note transporting route simple, and also even if the sensor for detecting the open/close of the shutter fails and the motor continues moving, the shutter merely performs the reciprocating motion to the left and right for a predetermined distance, so contact of the shutter and the bank-note transporting route, causing the shutter to lock, and damage the shutter means itself, can be prevented as much as possible, and as a result, the bank-note processing device performing stable shutter open/close operation with less failure can be provided.

INDUSTRIAL APPLICABILITY

As described above, the bank-note-processing unit of the present invention is suitable for an automatic vending machine, a money changing machine, a pachinko ball dispenser and a metal token dispenser.

What is claimed is:

1. A bank-note processing device comprising bank-note shifting means for temporarily inserting a bank-note transported from a bank-note slot and then parallel shifting the bank-note so as to store the bank-note in a stacker, having a pair of rotary drums which rotate in directions opposite from each other at a same phase, bank-note guide slits which are formed in the longitudinal direction of each cylindrical surface of the pair of rotary drums for temporarily inserting the transported bank-note, and a stacker chute which interlocks with the rotation of the pair of rotary drums for pushing the roughly center area of the bank-note inserted into the bank-note guide slits toward the stacker side; and a bank-note reverse-flowing-preventive lever which is disposed between the pair of rotary drums and near the leading ends of the bank-note guide slits for engaging with the bottom end of the bank-note parallel shifted from the bank-note guide slits to the stacker side, so as to prevent the return of the bank-note parallel shifted to the stacker side, characterized in that a stacker lever for pushing a portion positioned at the bank-note reverse-flowing-preventive lever side of the bank-note inserted in the bank-note guide slits toward the stacker side is disposed between the pair of rotary drums.

2. The bank-note processing device according to claim 1, characterized in that the stacker lever is driven by interlocking with the stacker chute via a link mechanism.

* * * * *